US011497971B2

(12) United States Patent
Martens et al.

(10) Patent No.: US 11,497,971 B2
(45) Date of Patent: Nov. 15, 2022

(54) GOLF CLUB HAVING A LOW MODULUS CROWN

(71) Applicant: Acushnet Company, Fairhaven, MA (US)

(72) Inventors: Grant M. Martens, Carlsbad, CA (US); Uday V. Deshmukh, Carlsbad, CA (US); Nick Frame, Vista, CA (US); Richard L. Cleghorn, Oceanside, CA (US); Takeshi Casey Funaki, San Diego, CA (US); Doug M. Takehara, Encinitas, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 17/364,508

(22) Filed: Jun. 30, 2021

(65) Prior Publication Data

US 2021/0394028 A1 Dec. 23, 2021

Related U.S. Application Data

(60) Division of application No. 16/746,277, filed on Jan. 17, 2020, now Pat. No. 11,077,340, which is a continuation of application No. 15/913,347, filed on Mar. 6, 2018, now Pat. No. 10,583,334.

(51) Int. Cl.
*A63B 53/04* (2015.01)

(52) U.S. Cl.
CPC ..... *A63B 53/0466* (2013.01); *A63B 53/0412* (2020.08); *A63B 53/0437* (2020.08); *A63B 2209/00* (2013.01)

(58) Field of Classification Search
CPC ..... A63B 53/0466; A63B 53/0437
USPC ..... 473/324–350
See application file for complete search history.

(56) References Cited

U.S. PATENT DOCUMENTS

| | | | |
|---|---|---|---|
| 5,624,331 | A | 4/1997 | Lo |
| 6,663,504 | B2 | 12/2003 | Hocknell |
| 6,875,126 | B2 | 4/2005 | Yabu |
| 6,955,612 | B2 | 10/2005 | Lu |
| 6,969,326 | B2 | 11/2005 | DeShiell |
| 7,022,032 | B2 | 4/2006 | Chen |
| 7,094,159 | B2 | 8/2006 | Takeda |
| 7,128,662 | B2 | 10/2006 | Kumamoto |

(Continued)

FOREIGN PATENT DOCUMENTS

| | | |
|---|---|---|
| JP | 2003111874 | 4/2003 |
| JP | 2004159854 | 6/2004 |

(Continued)

*Primary Examiner* — Alvin A Hunter

(57) ABSTRACT

A golf club head with a crown comprising an inner crown portion and an outer crown portion. The inner crown portion may be made of a low density or low elastic modulus material. The outer portion of the crown defines an opening to the cavity, a riser extending into the cavity, and a ledge extending from the edge of the riser. The ledge may define a first channel and a second channel that extend around the ledge. The first channel is filled with adhesive to secure the inner portion of the crown to the ledge. The inner portion of the crown is attached to the ledge such that the opening is covered by the inner portion of the crown. The golf club head may also have a sole comprising an inner sole portion and an outer sole portion.

20 Claims, 22 Drawing Sheets

(56) References Cited

U.S. PATENT DOCUMENTS

| | | | | |
|---|---|---|---|---|
| 7,175,541 | B2 | 2/2007 | Lo | |
| 7,214,142 | B2 | 5/2007 | Meyer | |
| 7,252,599 | B2 | 8/2007 | Hasegawa | |
| 7,261,645 | B2 | 8/2007 | Oyama | |
| 7,261,646 | B2 | 8/2007 | DeShiell | |
| 7,281,993 | B2 | 10/2007 | Oyama | |
| 7,281,994 | B2 | 10/2007 | DeShiell | |
| 7,297,074 | B2 | 11/2007 | Kumamoto | |
| 7,371,191 | B2 | 5/2008 | Sugimoto | |
| 7,396,291 | B2 | 7/2008 | Lo | |
| 7,435,190 | B2 * | 10/2008 | Sugimoto | A63B 53/0466 473/345 |
| 7,494,425 | B2 | 2/2009 | DeShiell | |
| 7,507,168 | B2 * | 3/2009 | Chou | A63B 53/0466 473/348 |
| 7,510,485 | B2 * | 3/2009 | Yamamoto | A63B 53/0466 473/348 |
| 7,530,901 | B2 | 5/2009 | Imamoto | |
| 7,530,903 | B2 | 5/2009 | Imamoto | |
| 7,553,242 | B2 | 6/2009 | Meyer | |
| 7,699,719 | B2 | 4/2010 | Sugimoto | |
| 7,749,103 | B2 | 7/2010 | Nakano | |
| 7,854,364 | B2 | 12/2010 | DeShiell | |
| 8,007,369 | B2 * | 8/2011 | Soracco | A63B 53/04 473/332 |
| 8,096,896 | B2 * | 1/2012 | De Schiell | A63B 53/0466 473/347 |
| 8,147,354 | B2 | 4/2012 | Hartwell | |
| 8,187,119 | B2 | 5/2012 | Rae | |
| 8,568,248 | B2 | 10/2013 | DeShiell | |
| 8,801,542 | B2 | 8/2014 | Sugimoto | |
| 8,961,335 | B2 * | 2/2015 | Sugimoto | A63B 53/0466 473/332 |
| 10,583,334 | B2 * | 3/2020 | Martens | A63B 53/0433 |
| 2004/0116207 | A1 * | 6/2004 | De Shiell | A63B 53/0466 473/345 |
| 2004/0116208 | A1 * | 6/2004 | De Shiell | A63B 60/00 473/345 |
| 2005/0026723 | A1 * | 2/2005 | Kumamoto | A63B 53/0466 473/345 |
| 2005/0215354 | A1 * | 9/2005 | Kumamoto | A63B 53/0466 473/349 |
| 2005/0261082 | A1 * | 11/2005 | Yamamoto | A63B 53/0466 473/345 |
| 2011/0152003 | A1 * | 6/2011 | Hartwell | A63B 53/0466 473/345 |
| 2019/0275384 | A1 * | 9/2019 | Martens | A63B 53/0433 |
| 2020/0023247 | A1 * | 1/2020 | Larsen | A63B 53/0466 |
| 2020/0147459 | A1 * | 5/2020 | Martens | A63B 53/0408 |
| 2021/0394028 | A1 * | 12/2021 | Martens | A63B 53/0433 |

FOREIGN PATENT DOCUMENTS

| | | | | |
|---|---|---|---|---|
| JP | 2004167127 | | 6/2004 | |
| JP | 2004180759 | | 7/2004 | |
| JP | 2005095298 | | 4/2005 | |
| JP | 2005137819 | | 6/2005 | |
| JP | 2005253606 | | 9/2005 | |
| JP | 2006020817 | | 1/2006 | |
| JP | 2006130065 | | 5/2006 | |
| JP | 2006130065 | A * | 5/2006 | A63B 53/0466 |
| JP | 2007125107 | | 5/2007 | |
| JP | 2007325727 | | 12/2007 | |
| JP | 2008035963 | | 2/2008 | |
| JP | 2008086349 | | 4/2008 | |
| JP | 2008228775 | | 10/2008 | |
| JP | 2009022571 | | 2/2009 | |
| JP | 2005296626 | | 1/2010 | |
| JP | 2006116002 | | 2/2011 | |
| JP | 2006247124 | | 2/2011 | |
| JP | 2005323686 | | 6/2011 | |
| JP | 2013034856 | | 2/2013 | |
| JP | 2013248180 | | 12/2013 | |
| TW | I224019 | B * | 11/2004 | |

* cited by examiner

| PPS Modulus (GPa) | Composite Modulus (GPa) | Target Modulus (GPa) | Vol. Frac. Composite | Vol. Frac. PPS |
|---|---|---|---|---|
| 5 | 480 | 20 | 0.0316 | 0.9684 |
| 5 | 490 | 20 | 0.0319 | 0.9681 |
| 5 | 500 | 20 | 0.0323 | 0.9677 |
| 5 | 510 | 20 | 0.0327 | 0.9673 |
| 5 | 520 | 20 | 0.0331 | 0.9669 |
| 5 | 530 | 20 | 0.0286 | 0.9714 |
| 5 | 540 | 20 | 0.0280 | 0.9720 |
| 5 | 550 | 20 | 0.0275 | 0.9725 |
| 5 | 560 | 20 | 0.0270 | 0.9730 |
| 5 | 570 | 20 | 0.0267 | 0.9733 |
| 5 | 580 | 20 | 0.0261 | 0.9739 |
| 5 | 590 | 20 | 0.0256 | 0.9744 |
| 5 | 600 | 20 | 0.0252 | 0.9748 |
| 5 | 610 | 20 | 0.0248 | 0.9752 |
| 5 | 620 | 20 | 0.0244 | 0.9756 |
| 5 | 630 | 20 | 0.0240 | 0.9760 |
| 5 | 640 | 20 | 0.0236 | 0.9764 |
| 5 | 650 | 20 | 0.0232 | 0.9768 |
| 5 | 660 | 20 | 0.0228 | 0.9772 |
| 5 | 670 | 20 | 0.0224 | 0.9776 |
| 5 | 680 | 20 | 0.0221 | 0.9779 |
| 5 | 690 | 20 | 0.0217 | 0.9783 |
| 5 | 700 | 20 | 0.0214 | 0.9786 |
| 5 | 710 | 20 | 0.0211 | 0.9789 |
| 5 | 720 | 20 | 0.0208 | 0.9792 |
| 5 | 730 | 20 | 0.0205 | 0.9795 |
| 5 | 740 | 20 | 0.0202 | 0.9798 |
| 5 | 750 | 20 | 0.0201 | 0.9799 |

| PPS Modulus (GPa) | Composite Modulus (GPa) | Target Modulus (GPa) | Vol. Frac. Composite | Vol. Frac. PPS |
|---|---|---|---|---|
| 5 | 760 | 20 | 0.0198 | 0.9802 |
| 5 | 770 | 20 | 0.0195 | 0.9805 |
| 5 | 780 | 20 | 0.0192 | 0.9808 |
| 5 | 790 | 20 | 0.0189 | 0.9811 |
| 5 | 800 | 20 | 0.0186 | 0.9814 |
| 5 | 810 | 20 | 0.0184 | 0.9816 |
| 5 | 820 | 20 | 0.0181 | 0.9819 |
| 5 | 830 | 20 | 0.0179 | 0.9821 |
| 5 | 840 | 20 | 0.0176 | 0.9824 |
| 5 | 850 | 20 | 0.0174 | 0.9826 |
| 5 | 860 | 20 | 0.0172 | 0.9828 |
| 5 | 870 | 20 | 0.0170 | 0.9830 |
| 5 | 880 | 20 | 0.0168 | 0.9832 |
| 5 | 890 | 20 | 0.0166 | 0.9834 |
| 5 | 900 | 20 | 0.0164 | 0.9836 |
| 5 | 910 | 20 | 0.0162 | 0.9838 |
| 5 | 920 | 20 | 0.0160 | 0.9840 |
| 5 | 930 | 20 | 0.0158 | 0.9842 |
| 5 | 940 | 20 | 0.0157 | 0.9843 |
| 5 | 950 | 20 | 0.0155 | 0.9845 |
| 5 | 960 | 20 | 0.0153 | 0.9847 |
| 5 | 970 | 20 | 0.0152 | 0.9848 |
| 5 | 980 | 20 | 0.0150 | 0.9850 |
| 5 | 990 | 20 | 0.0149 | 0.9851 |
| 5 | 1000 | 20 | 0.0147 | 0.9853 |
| 5 | 1010 | 20 | 0.0146 | 0.9854 |
| 5 | 1020 | 20 | 0.0144 | 0.9856 |
| 5 | 1030 | 20 | 0.0143 | 0.9857 |
| 5 | 1040 | 20 | 0.0141 | 0.9859 |
| 5 | 1050 | 20 | 0.0140 | 0.9860 |
| 5 | 1060 | 20 | 0.0139 | 0.9861 |
| 5 | 1070 | 20 | 0.0137 | 0.9863 |
| 5 | 1080 | 20 | 0.0136 | 0.9864 |
| 5 | 1090 | 20 | 0.0135 | 0.9865 |
| 5 | 1100 | 20 | 0.0134 | 0.9866 |
| 5 | 1110 | 20 | 0.0133 | 0.9867 |
| 5 | 1120 | 20 | 0.0132 | 0.9868 |
| 5 | 1130 | 20 | 0.0131 | 0.9869 |
| 5 | 1140 | 20 | 0.0130 | 0.9870 |
| 5 | 1150 | 20 | 0.0129 | 0.9871 |
| 5 | 1160 | 20 | 0.0128 | 0.9872 |
| 5 | 1170 | 20 | 0.0127 | 0.9873 |
| 5 | 1180 | 20 | 0.0126 | 0.9874 |
| 5 | 1190 | 20 | 0.0125 | 0.9875 |
| 5 | 1200 | 20 | 0.0124 | 0.9876 |

FIG. 1H

GOLF CLUB HAVING A LOW MODULUS CROWN

CROSS-REFERENCE TO RELATED APPLICATIONS

This application is a divisional of and claims the benefit of priority from U.S. application Ser. No. 16/746,277, titled "GOLF CLUB HAVING A LOW MODULUS CROWN," filed Jan. 17, 2020, which is a continuation of U.S. application Ser. No. 15/913,347, titled "GOLF CLUB HAVING A LOW MODULUS CROWN," filed Mar. 6, 2018, the entirety of which is incorporated herein by reference.

BACKGROUND

The flight characteristics of a golf ball after being struck by a golf club are dependent on not only on the swing of the golf club but also on the construction of the golf club itself. For instance, flight characteristics of a golf ball, such as spin of the ball and ball speed, are impacted by the design and construction of the golf club. By modifying the golf club design, the flight characteristics can be improved. Some modifications to golf clubs that improve flight characteristics of a golf ball, however, may also reduce durability of the golf club, increase its overall weight, cause undesirable acoustic responses, or create other disadvantageous features of the golf club. As such, improvements to golf club designs that both improve ball flight characteristics and limit disadvantageous consequences are desired.

SUMMARY

In an aspect, the technology relates to a golf club head including a sole positioned on a bottom side of the golf club head, a striking face positioned toward the front of the golf club head and attached to at least a portion of the sole, and a crown positioned on a top side of the golf club head such that a cavity is formed between the sole, the striking face, and the crown. The crown includes an outer portion made of a first material and an inner portion made of a second material. The outer portion defines: an opening to the cavity, wherein the opening has a center, a riser extending into the cavity, the riser having a bottom edge, and a ledge extending from the edge of the riser towards the center. The ledge defines a first channel and a second channel that extend around the ledge, and the first channel is filled with an adhesive to secure the inner portion of the crown to the ledge. The inner portion of the crown is attached to the ledge such that the opening is covered by the inner portion of the crown. In an example, the first channel has a volume greater than a volume of the second channel. In another example, a distance between the first channel and the riser is less than a distance between the second channel and an inner edge of the ledge. In yet another example a width of the ledge varies around a perimeter of the opening such that a maximum ledge width is disposed proximate the striking face of the golf club head and a minimum ledge width is disposed proximate a rear of the golf club head. In still yet another example, a ratio between the maximum ledge width and the minimum ledge width is at least 2:1.

In another example, a thickness of the ledge is less than a thickness of a remainder of the outer portion of the crown. In yet another example, the inner portion of the crown comprises at least about 85% of an exterior surface area of the crown. In still yet another example, the second material is at least one of a wood-based material and a material displaying an elastic modulus of about 10 GPa to about 50 GPa. In another aspect, an offset distance between the striking face and the inner portion of the crown is between about 10 mm to about 20 mm.

In another aspect, the technology relates to a golf club head including a sole positioned on a bottom side of the golf club head, a striking face positioned toward the front of the golf club head and attached to at least a portion of the sole, a crown positioned on a top side of the golf club head such that a cavity is formed in between the sole, the striking face, and the crown, wherein the crown includes an outer portion made of a first material and an inner portion made of a second material, wherein the outer portion defines an opening to the cavity, wherein the opening has a center, a shelf attached to an internal surface of the outer portion of the crown around a perimeter of the opening, wherein the shelf extends towards the center, and wherein the inner portion of the crown is attached to the shelf such that the opening is covered by the inner portion of the crown. In an example, the first material is titanium and the second material is one of a wood-based material and a magnesium-based material. In another example, the second material displays an elastic modulus of between about 5 GPa to about 20 GPa. In yet another example, the inner portion of the crown is formed from a polyphenylene sulfide (PPS) material and a composite material. In still yet another example, the PPS material comprises at least about 90% of a volume of the inner portion of the crown.

In another example, the inner portion is separated from the outer portion by one of the shelf or a polymer spacer around a perimeter of the inner portion. In yet another example, the shelf is adhesively attached to the internal surface of the outer portion of the crown and the inner portion of the crown is adhesively attached to the shelf.

In another aspect, the technology relates to a golf club head including a sole positioned on a bottom side of the golf club head. The sole includes an outer sole portion made of a first material and an inner sole portion made of a second material. The golf club head also includes a striking face positioned toward the front of the golf club head and attached to at least a portion of the sole. The golf club head also includes a crown positioned on a top side of the golf club head such that a cavity is formed between the sole, the striking face, and the crown. The crown includes an outer crown portion made of the first material and an inner crown portion made of the second material. The outer crown portion defines a first opening to the cavity, wherein the first opening has a center, a crown riser extending into the cavity, the crown riser having a bottom edge, and a crown ledge extending from the bottom edge of the crown riser towards the center of the first opening. The outer sole portion defines a second opening to the cavity, wherein the second opening has a center, a sole riser extending into the cavity, the sole riser having a top edge, and a sole ledge extending from the top edge of the sole riser towards the center of the second opening. The inner crown portion is attached to the crown ledge such that the first opening is covered by the inner crown portion. The inner sole portion is attached to the sole ledge such that the second opening is covered by the inner sole portion. In an example, the first opening and second opening are portions of a single continuous opening. In another example, the inner sole portion and the inner crown portion are portions of a single continuous portion made of the second material. In yet another example, the sole ledge defines a first channel and a second channel that extend around the sole ledge, wherein the first channel is filled with an adhesive to secure the inner sole portion to the sole ledge.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

Non-limiting and non-exhaustive examples are described with reference to the following Figures.

FIG. 1H is a table of example material quantities suitable for an inner portion of a crown for an example golf club head.

DETAILED DESCRIPTION

The technologies described herein contemplate a golf club head, such as a fairway metal, driver, or other golf club head, that includes a crown and/or a sole that has an inner portion having a low elastic modulus (also known as the Young's Modulus) and may also have a low density. One goal of golf club construction is often to reduce the overall mass of the golf club head or at least reduce the mass of particular components. The reduction of mass, however, can often lead to less durable golf club heads. The present technologies provide for a golf club head that with a crown that has at least two portions: an outer portion that is made of traditional materials, such as titanium, and an inner portion that made from a low density or low elastic modulus material. By reducing the density of a portion of the crown, the overall mass of the crown and the club can be reduced. Reducing the amount of mass dedicated to the crown also allows for incorporation of active recoil channels or discretionary mass, such as removable weights, to modify a center-of-gravity (CG) location. Incorporating a low modulus material into the crown also provides performance improvements, such as increased ball speed and ball spin improvements, by increasing the flexibility of the crown while maintaining durability. Similar techniques for increasing the flexibility of the crown may also be applied to the sole of the golf club head. Prior attempts to modify the crown of a golf club to increase performance have generally utilized a slot, but the present technology eliminates the need for such a structure.

Figure 1A:
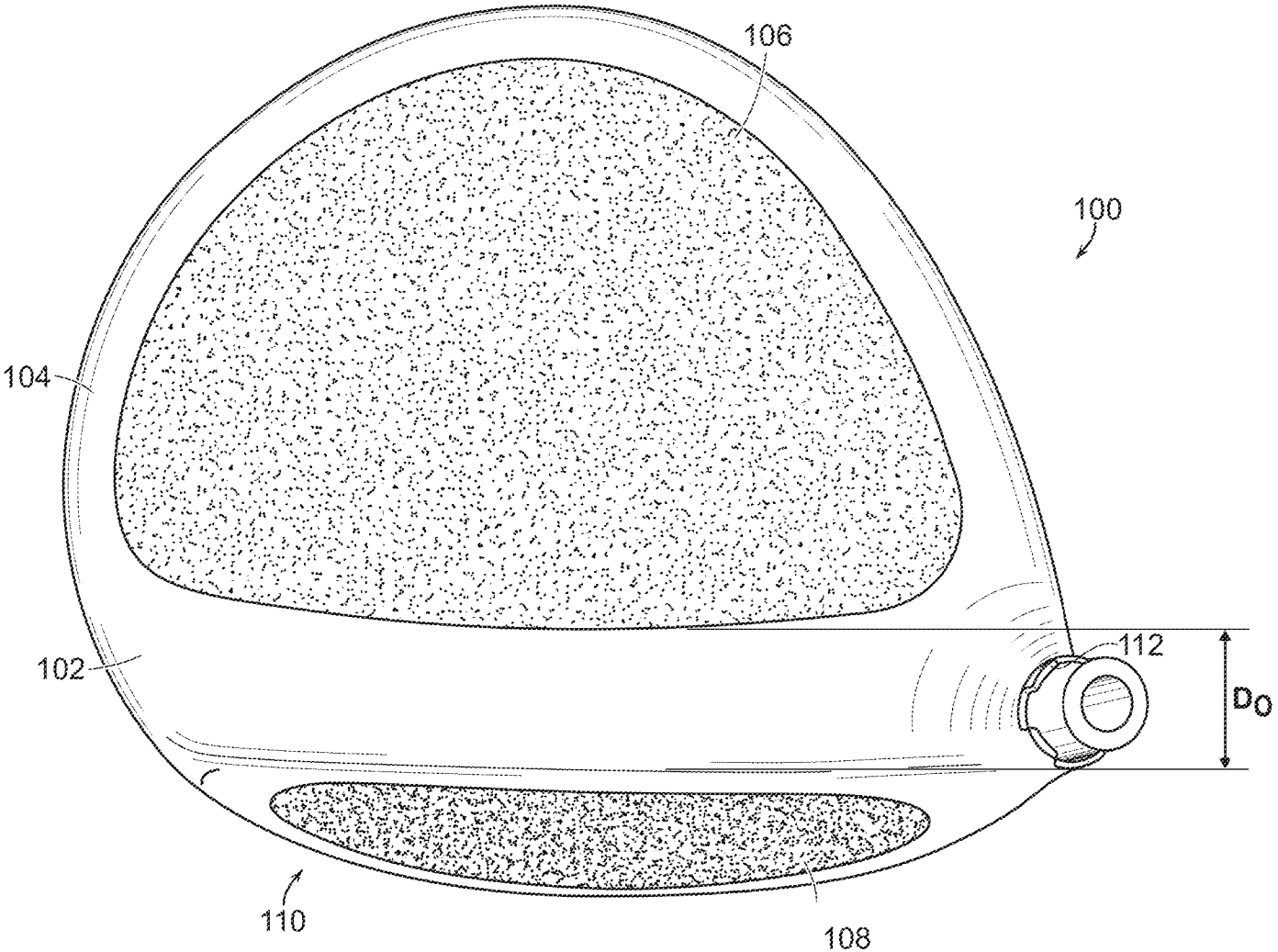
FIG. 1A depicts a top view of an example of a golf club.
Figure 1B:
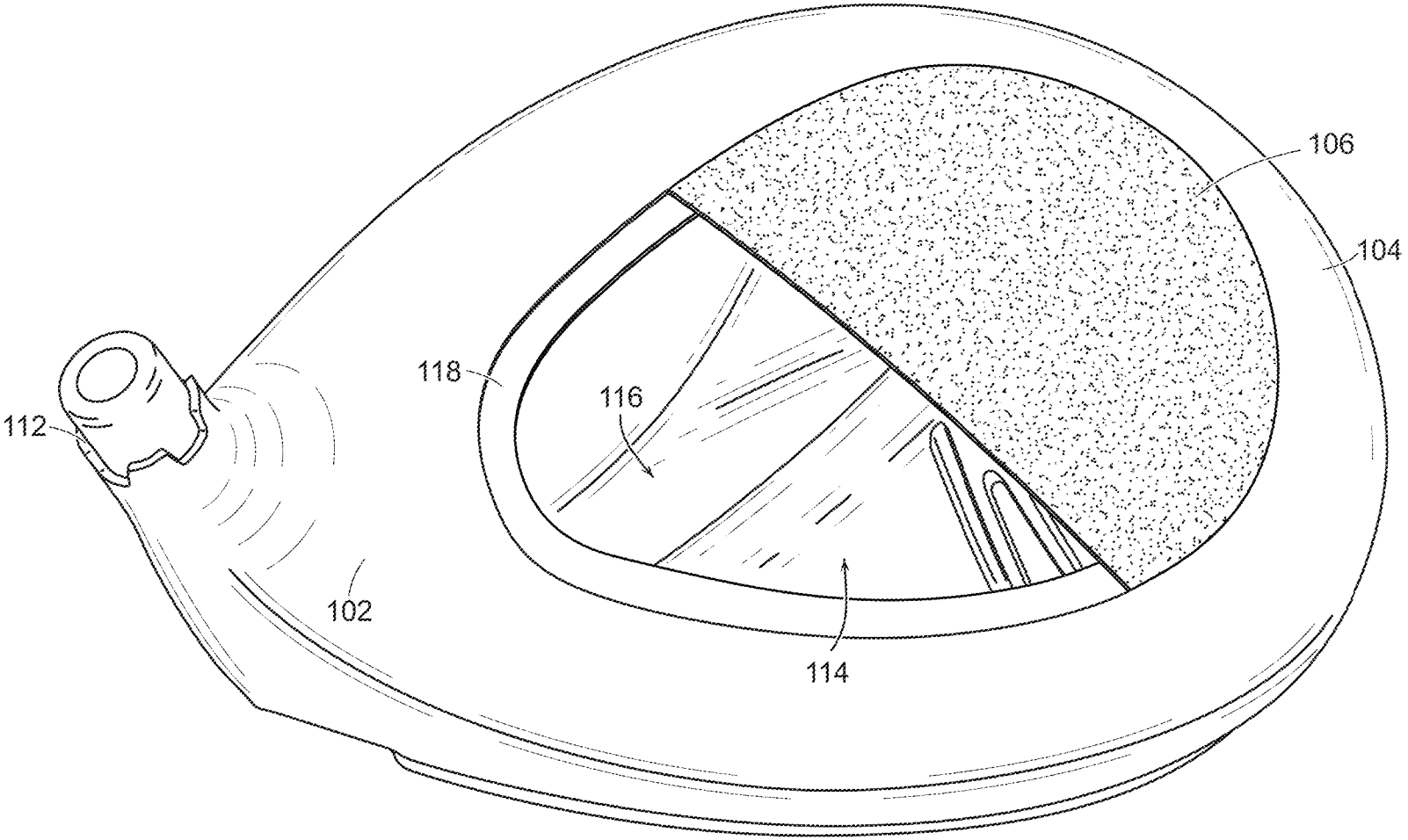
FIG. 1B depicts a perspective view of the golf club of FIG. 1A showing a partial section view of the golf club head.

FIG. 1A depicts a top view of a golf club head 100, FIG. 1B depicts a perspective view of the golf club head 100 showing a partial section view of the golf club head 100. FIGS. 1A-1B are described concurrently. The golf club head 100 has a crown 102 on the top side of the golf club head 100 attached to a striking face 108 positioned towards the front of the golf club head 100 and a sole 110 on the bottom side of the golf club head 100. The crown 102, the striking face 108, and the sole 110 are attached so as to form a cavity 116 in the golf club head 100. In some examples, a skirt may also be included between the crown 102 and the sole 110. In such examples, for purposes of this application, the crown 102 is still considered to be attached or connected to the sole 110.

The crown 102 is made from at least two components: an outer portion 104 made from a first material and an inner portion 106 made from a second material. The outer portion 104 of the crown 102 may be made from a traditional golf club material, such as a titanium-based or a steel-based material. The inner portion 106 of the crown 102 is made from a non-traditional material that may have a low elastic modulus and/or a low density. For example, the inner portion 106 of the crown 102 may be formed of a material that has an elastic modulus between 10-50 GPa. The performance advantages resulting from the use of materials having an elastic modulus within this range are discussed further below with reference to FIGS. 1D-1G.

Some examples of materials that may be used for the inner portion 106 of the crown 102 include wood-based materials, lignin-based materials, cellulose-based materials, or magnesium-based materials. Wood-based materials generally display an elastic modulus between 1-20 GPa, whereas magnesium-based materials generally display an elastic modulus of about 45 GPa. The use of wood-based materials also include additional benefits of having a low density, sound-dampening characteristics, and flexibility. The flexibility of the wood-based material allows the inner portion 106 to be more easily shaped or formed to match the contours of the outer portion 104 of the crown 102. In examples where a wood-based material is used, a veneer may also be attached to the top side of the wood-based material. The use of magnesium-based materials also provides the benefit of being low density, can be easily cast, and are resistant to scratching.

Other suitable materials for the inner portion 106 include a glass fiber reinforced plastic (displaying an elastic modulus of about 20-50 GPa), a composite or Kevlar fiber reinforced nylon or plastic (displaying an elastic modulus of about 5-50 GPa), or a thermoplastic combination (displaying an elastic modulus of about 1-10 GPa). Each of these materials also includes the benefit of being able to be 3D printed. In addition, a material with a polyphenylene sulfide (PPS) in combination with a composite is also be suitable. The use of the PPS provides a desirable metallic sound when the golf club head 100 strikes a golf ball, and the composite is used in combination to raise the elastic modulus of the resultant materials. Fractional volumes of PPS and composites for a suitable material are discussed further below with reference to FIG. 1H.

The inner portion 106 of the crown 102 is shaped so as to match the contours of the outer portion 104 of the crown 102. The size of the inner portion 106 may be about 50-100% of the exterior surface area of the crown 102. In some examples, the size of the inner portion 106 is at least 85% of the exterior surface area of the crown 102. The inner portion 106 is also offset from the striking face 108 or the front edge of the crown by an offset distance (Do). The offset distance (Do) may range from about 10-30 mm, 10-20 mm, 20-30 mm, or 15-25 mm. In some examples, the offset distance (Do) is about 15 mm. The performance effects of the offset distance (Do) are discussed further below with reference to FIG. 1E. The inner portion 106 may also be shaped to substantially match the shape of the outer portion 104 and be offset from the outer edges of the crown 102 by an amount sufficient to not interfere with the hosel 112.

The inner portion 106 of the crown 102 is attached to the outer portion 104 via a ledge 118 formed by the outer portion 104 of the crown 102. The outer portion 104 defines an opening to the cavity 116 of the golf club head 100. The ledge 118 extends towards the center of the opening to create a bonding surface for the inner portion 106 to be attached. The inner portion 106 may be attached to the ledge 118 with an adhesive or other bonding mechanism.

Figure 1C:
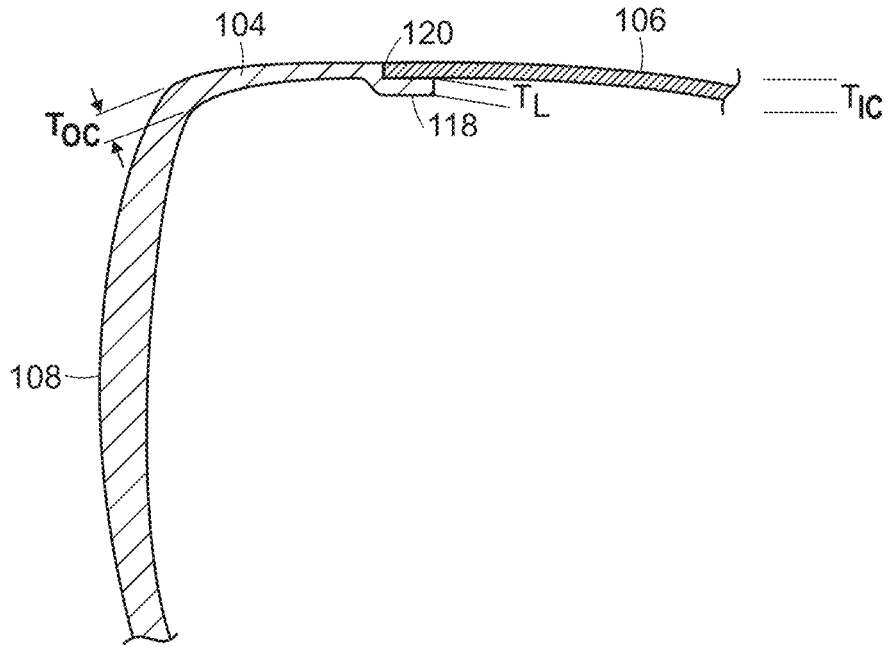
FIG. 1C depicts a partial section view of the golf club head of FIGS. 1A-1B.

The arrangement of the outer portion 104, ledge 118, and the inner portion 106 can be further seen in FIG. 1C, which depicts a partial section view of the golf club head 100. To form the ledge 118, the outer portion 104 defines a riser 120 that that extends into the cavity 116. The ledge 118 extends from the bottom edge of the riser 120 towards the center of the opening 114. The thicknesses of the respective components can also be seen in FIG. 1C. The inner portion 106 of the crown 102 has a thickness ($T_{IC}$), the outer portion has a thickness ($T_{OC}$), and the ledge has a thickness ($T_L$). In some examples, the inner portion thickness ($T_{IC}$) is substantially the same as the outer portion thickness ($T_{OC}$). In such examples, the riser 120 extends further into the cavity 116 such that the top surface of the inner portion 106 and the top surface of the outer portion 104 are substantially flush with one another. In general, the height of the riser 120 is substantially the same as the inner portion thickness ($T_{IC}$). In other examples, the inner portion thickness ($T_{IC}$) is less than the outer portion thickness ($T_{OC}$). For instance, the inner portion thickness ($T_{IC}$) may be about 0.4-0.6 mm thick, such as 0.4 mm, 0.5 mm, or 0.6 mm. In other examples, the inner portion thickness may be between about 0.4-1.0 mm. In examples where the inner crown thickness ($T_{IC}$) is less than the outer crown thickness ($T_{OC}$), the ratio of the inner crown thickness ($T_{IC}$) to the the outer crown thickness ($T_{OC}$) may be about 2:3 or 1:2. The performance effects due to the inner crown thickness ($T_{IC}$) are discussed further below in FIG. 1D. In some examples, the ledge thickness ($T_L$) may be the same as the outer portion thickness ($T_{OC}$) or the inner portion thickness ($T_{IC}$). In other examples, the ledge thickness ($T_L$) may be substantially equal to the difference between the outer portion thickness ($T_{OC}$) and the inner portion thickness ($T_{IC}$).

Figure 1D:
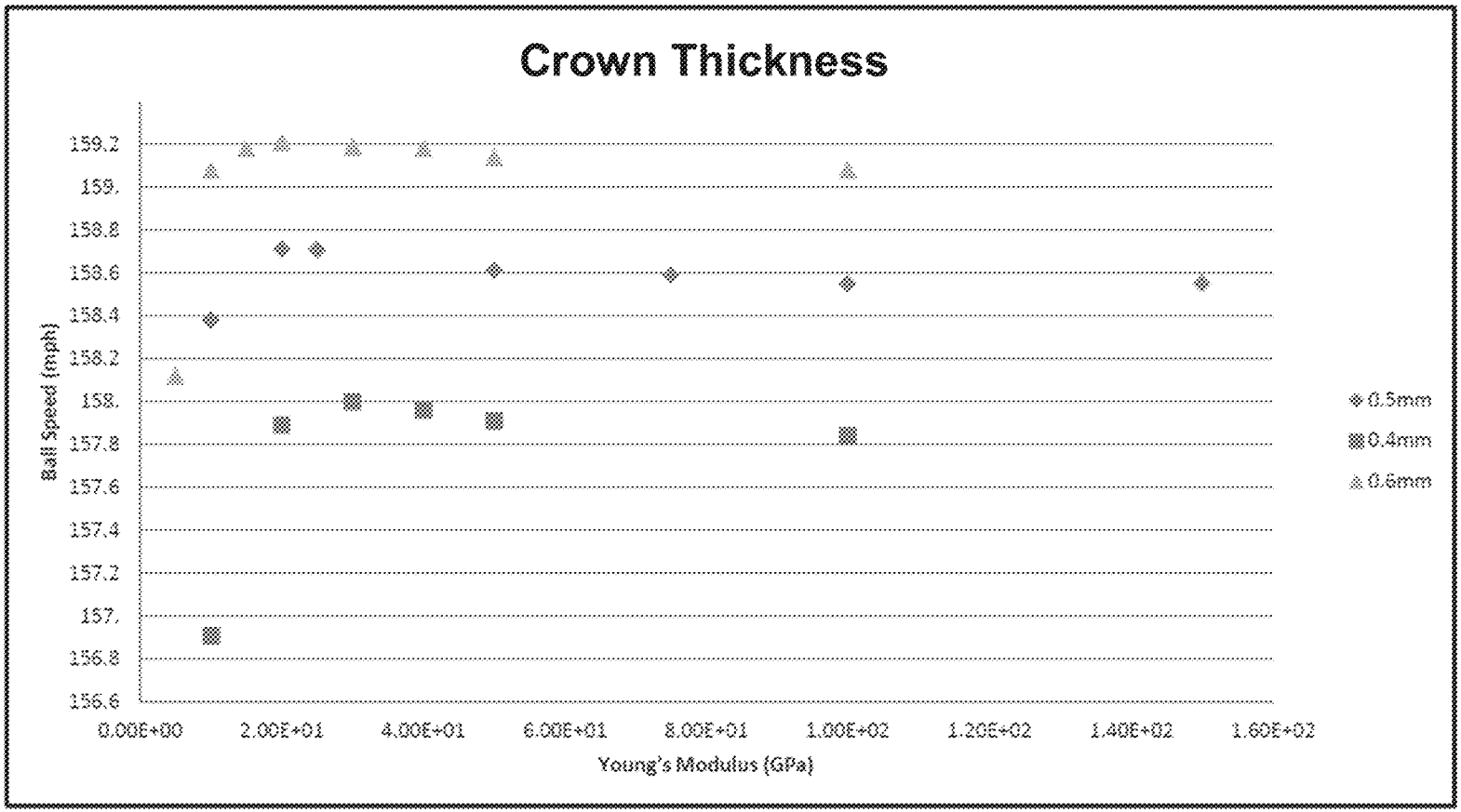
FIG. 1D is a plot showing effects of elastic modulus and crown thickness on ball speed for an example golf club head.

FIG. 1D is a plot showing effects of elastic modulus (labeled Young's Modulus) and crown thickness on ball speed for an example golf club head. Multiple data points are shown for an inner crown portion having a thickness of 0.4 mm, 0.5 mm, and 0.6 mm. In general, the plot indicates that for most elastic modulus values, a thicker inner crown portion results in higher ball speed values for resultant ball strikes with the example golf club. In addition, the plot also shows an unexpected result of an increase in ball speed resulting from the use of an inner crown portion having an elastic modulus value within a particular range. More specifically, ball speed increases are observed for inner crown portions having an elastic modulus value from about 10-40 GPa. Each thickness of inner crown portion also has its own respective optimal elastic modulus as well. For instance, for an inner crown portion having a 0.5 mm thickness, an optimal elastic modulus occurs at about 20 GPa. Higher thicknesses of an inner crown portion generally resulted in a lower optimal elastic modulus value. The results for the plot were created via finite element analysis for an example golf club similar to that depicted in FIGS. 1A-1C with the TITLEIST 917 D3 Driver being the base model for the example golf club.

Figure 1E:
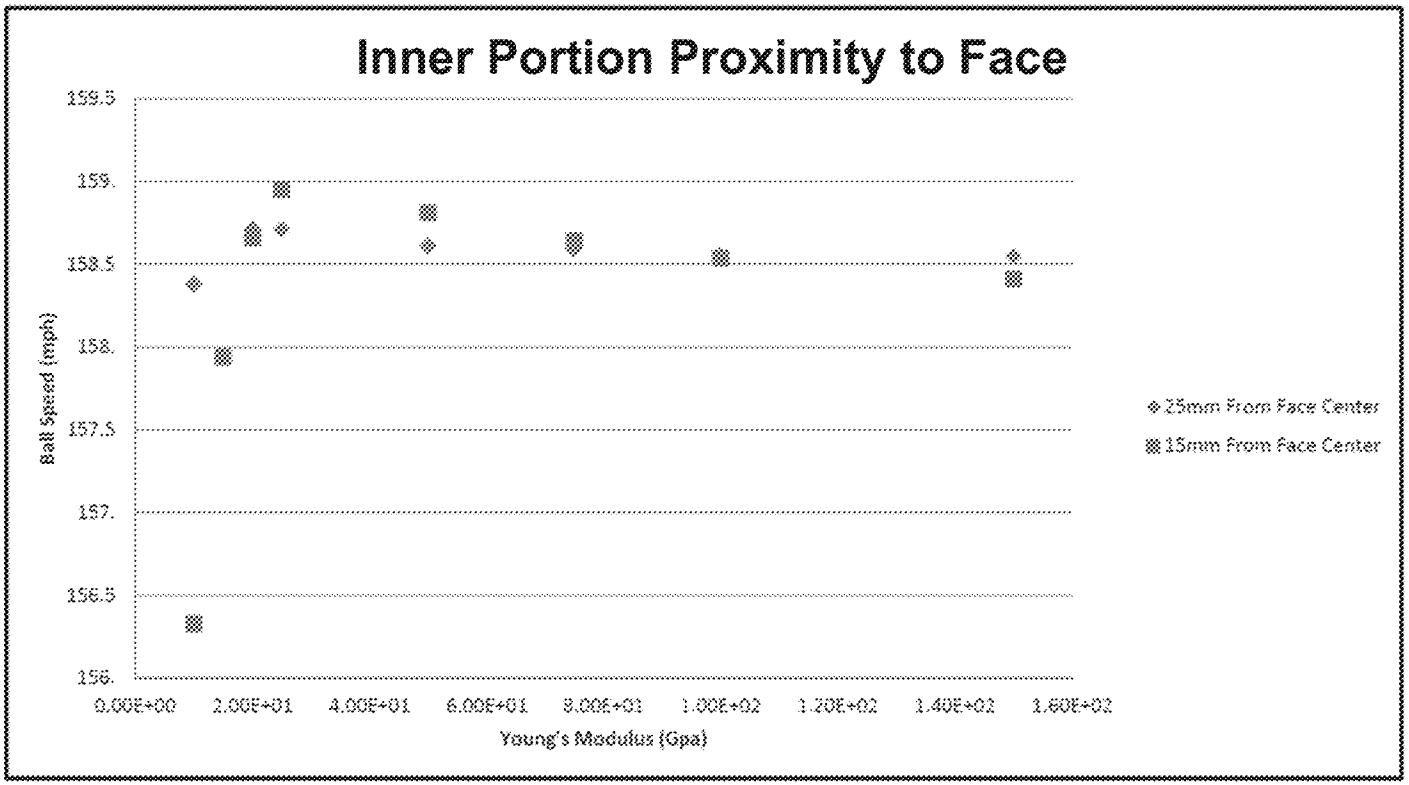
FIG. 1E is a plot showing the effects of elastic modulus and an inner crown portion's proximity to the striking face on ball speed for an example golf club head.

FIG. 1E is plot showing the effects of elastic modulus and an inner crown portion's proximity to the striking face on ball speed for an example golf club head. Multiple data points are shown for an inner crown portion having an offset distance ($D_O$) of 15 mm and 25 mm. From the plot, it can be seen that moving the inner crown portion closer to the striking face results in higher ball speeds for certain ranges of elastic modulus values. For instance, for an elastic modulus value between about 20-30 GPa, ball speeds are increased where the inner crown portion has an offset distance ($D_O$) of 15 mm rather than 25 mm. The results depicted in the plot were generated using finite element analysis for the same example golf club used for the plot in FIG. 1D.

Figure 1F:
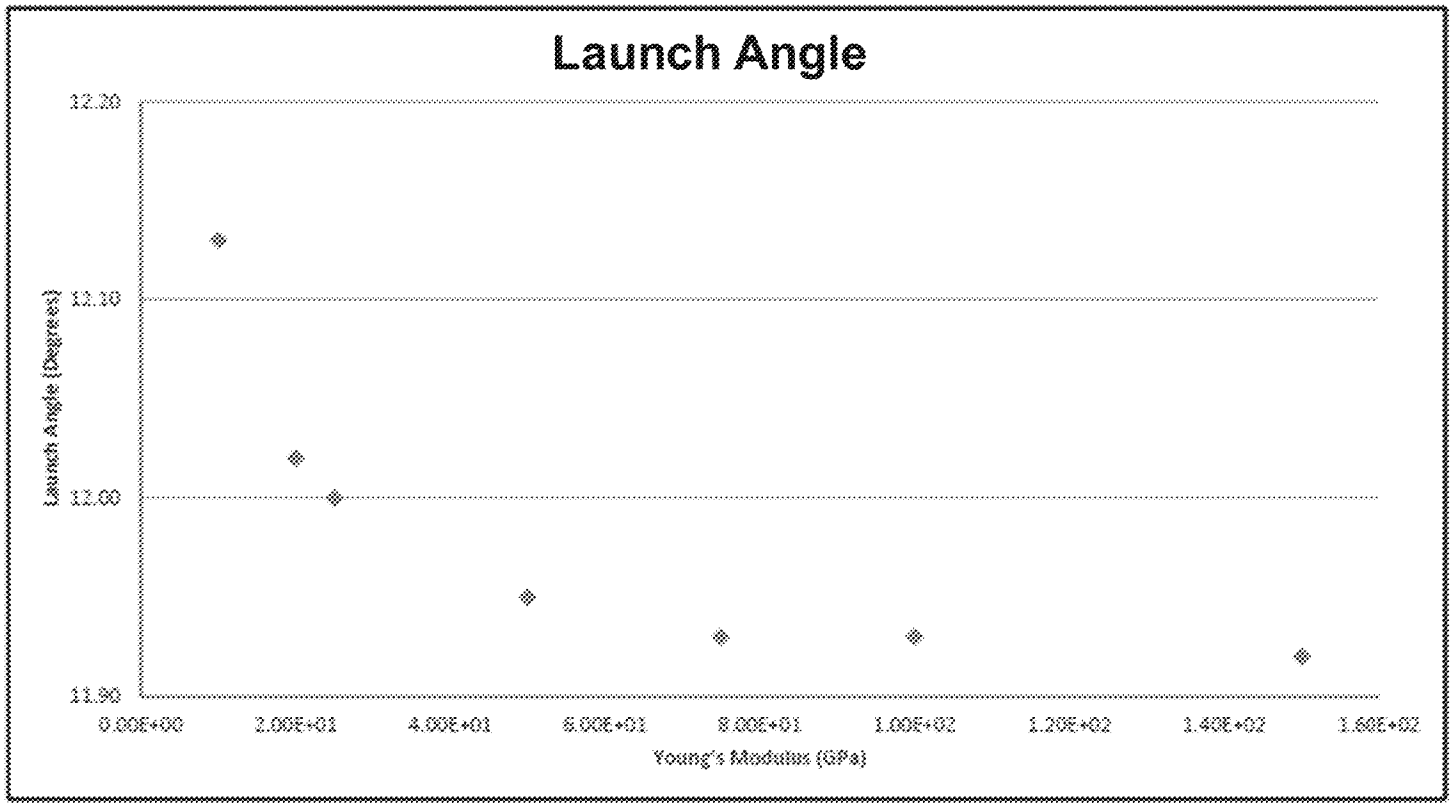
FIG. 1F is a plot showing the effect of elastic modulus on launch angle for an example golf club.

FIG. 1F is a plot showing the effect of elastic modulus on launch angle for an example golf club having an inner portion with a 0.5 mm thickness. Multiple data points are shown for high ball strikes (about a half inch above face center) on the example golf club utilized for the plots in FIGS. 1D-1E. As can be seen from the plot, the launch angle generally decreases as the elastic modulus increases.

Figure 1G:
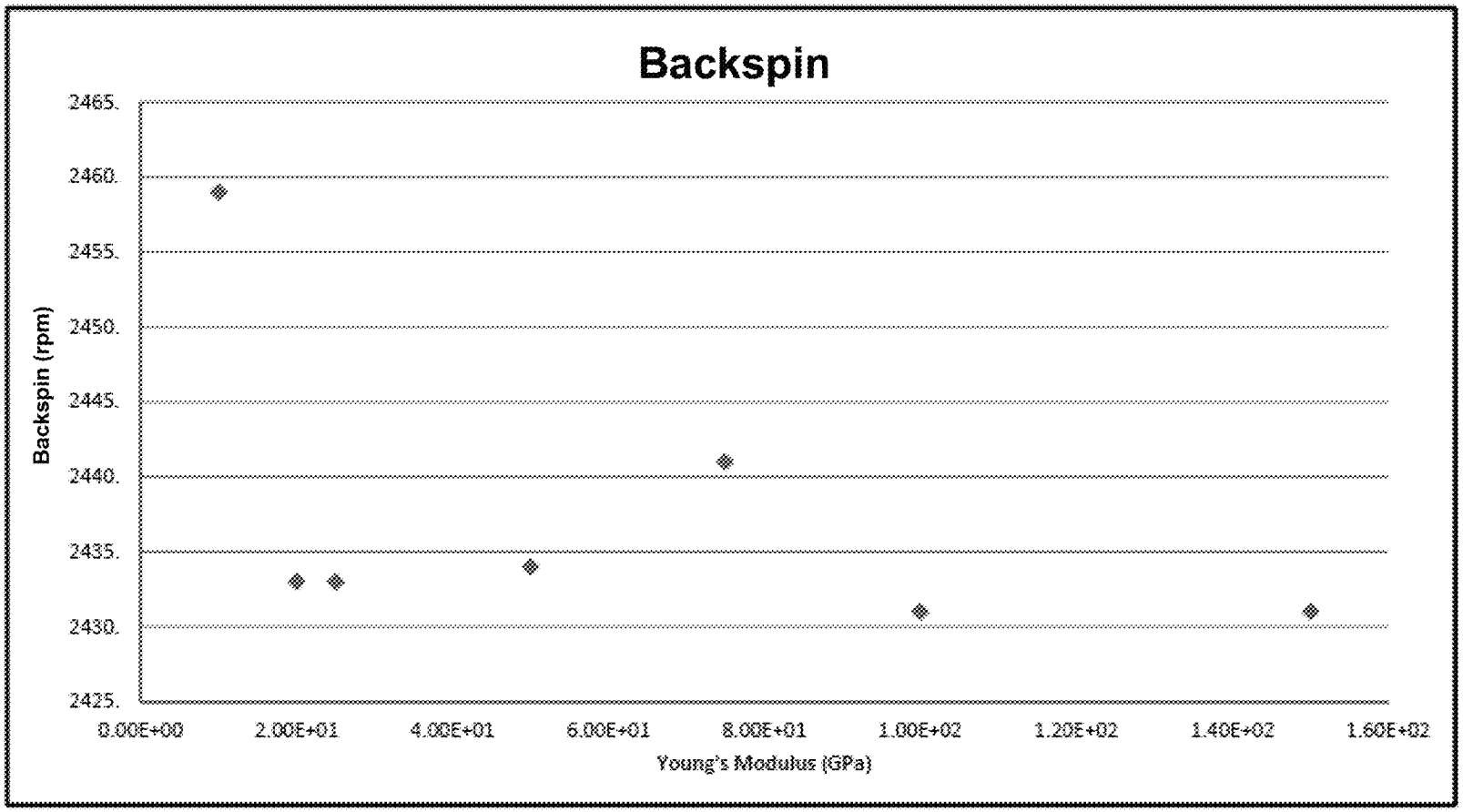
FIG. 1G is a plot showing the effect of elastic modulus on backspin of a golf ball for an example golf club head.

FIG. 1G is a plot showing the effect of elastic modulus on the backspin of a golf ball for an example golf club head having an inner portion with a 0.5 mm thickness. Multiple data points are shown for high ball strikes (about a half inch above face center) on the example golf club utilized for the plots in FIGS. 1D-1F. As can be seen from the plot, there is a reduction in backspin for inner crown portions having elastic modulus values within particular ranges. For instance, the unexpected result of backspin decrease for elastic modulus values of 15-60 GPa is seen. In particular, a decrease in backspin occurs for elastic modulus values between about 20-25 GPa. By reducing backspin, additional carry distance of a golf ball can be achieved.

FIG. 1H is table of example materials suitable for an inner portion of a crown for an example golf club head. As discussed above, a material with a polyphenylene sulfide (PPS) in combination with a composite may be suitable for use in an inner crown portion. The table in FIG. 1H provides different fractional volumes of PPS with composites having varied elastic modulus values to achieve a target elastic modulus of 20 GPa. The first column of the table lists the elastic modulus value for PPS (about 5 GPa), the second column lists the elastic modulus of a sample composite material, the third column lists the target elastic modulus (20 GPa for the present example), the fourth column lists the fractional volume of composite needed to result in the target elastic modulus, and the fifth column lists the fractional volume of PPS needed to result in the target elastic modulus. As an example from the table, for a composite having an elastic modulus of 200 GPa, a material suitable for an inner crown portion having an elastic modulus of about 20 GPa has 7.69% composite and 92.31% PPS by volume. In light of this disclosure, similar fractional volumes may be determined for other target elastic modulus values. By having a large amount of PPS as compared to the composite amount (such as greater than 90% PPS), the acoustic properties of the PPS are dominant. Any material having the combination of PPS and composite listed in the able in FIG. 1H may be suitable for use in an inner portion of a crown.

Figure 2A:
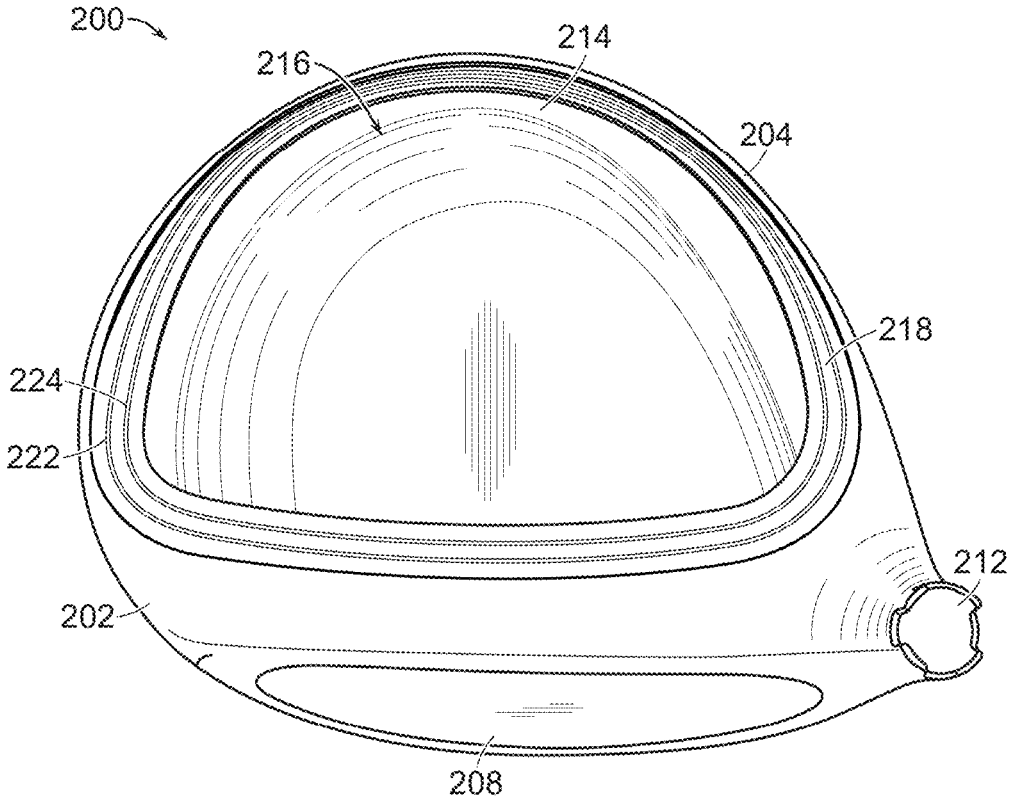
FIG. 2A depicts an example of a golf club head with an inner portion of the crown removed.

FIG. 2A depicts an example of a golf club head 200 with an inner portion of the crown 202 removed. The golf club head 200 is substantially similar to the golf club head 100 depicted above in FIGS. 1A-1C except the golf club head 200 includes channels 222, 224 for receiving adhesive to attach the inner portion of the crown to the ledge 218. The channels 222, 224 increase the surface area for the adhesive to adhere, which creates a stronger bond. In addition, the channels 222, 224 help prevent overflow of the adhesive into the cavity 216, which would cause an undesirable rattle or noise in the golf club head 200. As an example, adhesive may be added to the main or first channel 222, but not the second channel 224. As the inner portion is pressed against the ledge 218 to be attached, the adhesive flows from the first channel 222 across the ledge 218 to the overflow or second channel 224, where the excess adhesive is captured before being able to flow into the cavity 216. The process of attaching the inner portion to the ledge 218 is discussed in further detail below with reference to FIG. 3. As another advantage, the amount of adhesive can also be controlled through the use of the channels 222, 224. In other golf clubs, parts are often attached with large globs of epoxy, which results in unnecessary additional mass in the golf club. With the present technology, however, the amount of adhesive added can be controlled and based on the volume of the first channel 222 and/or the second channel 224 to provide a consistent amount of adhesive.

Similar to the golf club head 100 depicted in FIGS. 1A-1C, the golf club head 200 includes a crown 202 attached to a sole and a striking face 208 to form a cavity 216. The outer portion 204 of the crown 202 also defines a ledge 218 for attaching the inner portion of the crown 202. A first channel 222 and a second channel 224 are formed in the ledge 218 to receive an amount of adhesive to bond the inner portion of the crown 202 to the ledge 218. The first channel 222 extends around the ledge and is offset from the outer edges of the golf club head 200 by a smaller distance than the second channel 224, which also extends around ledge 218.

Figure 2B:
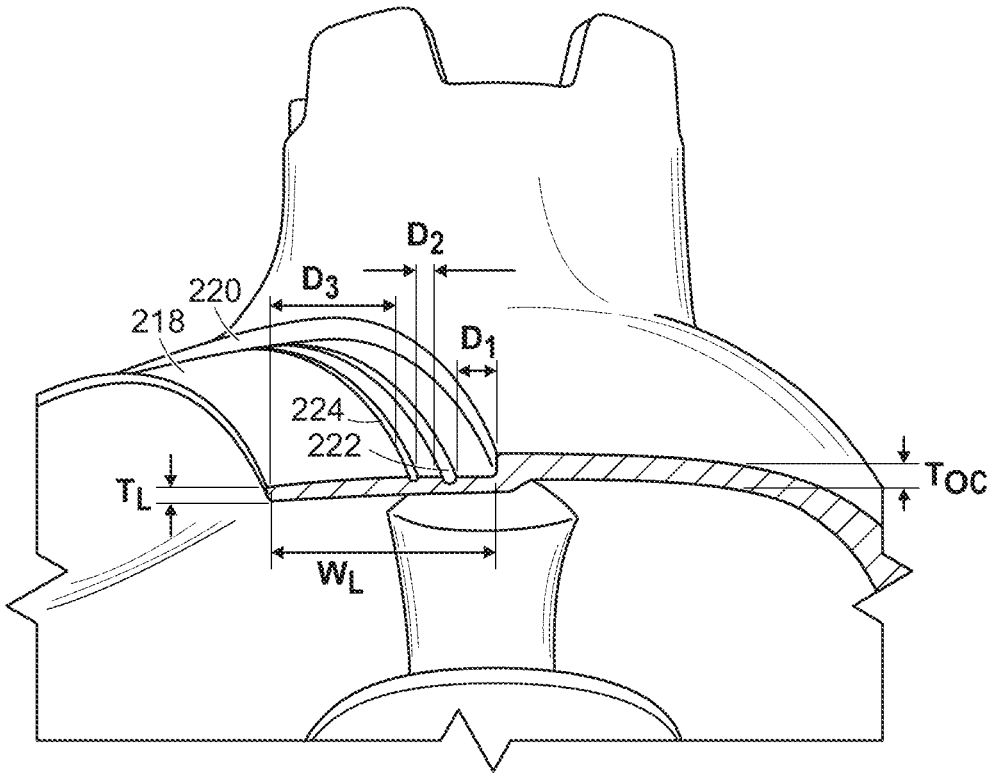
FIG. 2B depicts a partial section view of the golf club head of FIG. 2A proximate the face of the golf club head.
Figure 2C:
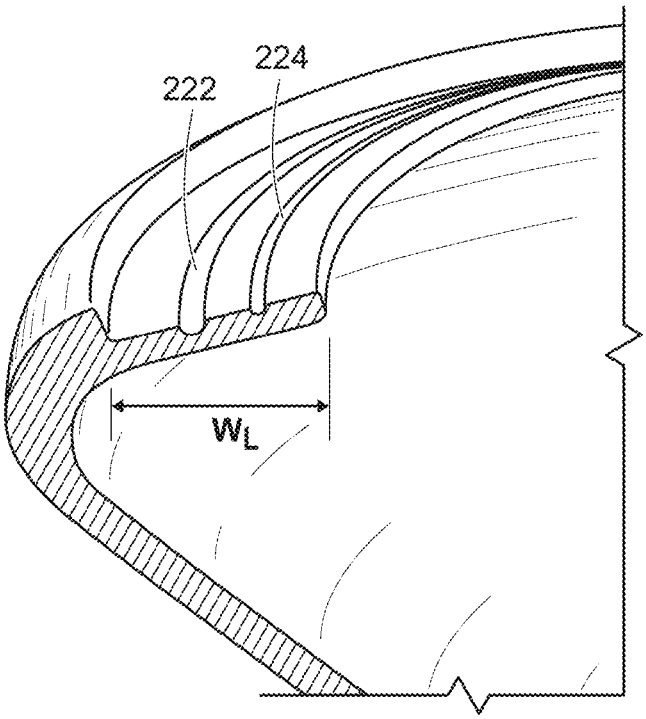
FIG. 2C depicts a partial section view of the golf club head of FIGS. 2A-2B proximate the rear of the golf club.
Figure 2D:
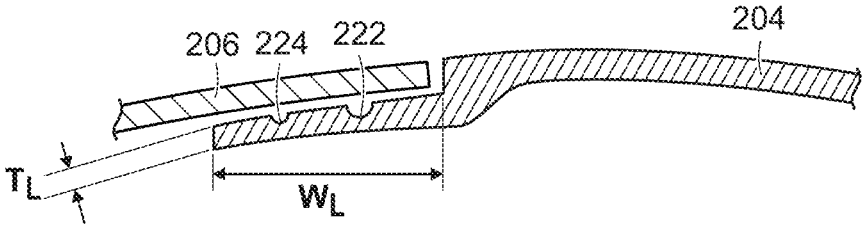
FIG. 2D depicts another partial section view of the golf club head of FIGS. 2A-2C.

Further details of the channels 222, 224 can be seen in FIGS. 2B and 2D, which depict partial section views of the golf club head 200. In the example depicted, the first channel 222 and the second channel 224 have a substantially semi-circle or half-circle contour. The first channel 222 has a radius ($R_1$) and the second channel 224 has a radius ($R_2$). Accordingly, the volume ($V_1$) of the first channel 222 may be defined as $$V_1 = \frac{\pi R_1^2 L_1}{2},$$

where $L_1$ is the length of the first channel 222. Similarly, the volume ($V_2$) of the second channel 224 may be defined as $$V_2 = \frac{\pi R_2^2 L_2}{2},$$

where $L_2$ is the length of the second channel 224. While the channels 222, 224 in the example depicted have a half-circle shape, other shapes could also be used and one having skill in the art would understand how to determine the volumes of such channels. In some examples, the radius ($R_1$) of the first channel 222 may be between about 0.2-0.4 mm and the radius of the second channel may be between about 0.1-0.2 mm. In a particular example, the radius ($R_1$) of the first channel 222 is about 0.25 mm and the radius ($R_2$) of the second channel 224 may be about 0.15 mm. The ratio between the radius ($R_1$) of the first channel 222 and the radius ($R_2$) of the second channel 224 may be about 2:1, 5:3, or 3:2.

The first channel 222 is offset from the riser by a distance D1. The second channel 224 is offset from the first channel 222 by a distance D2, and the second channel 224 is offset from the inner edge of the ledge 218 by a distance D3. In some examples, the distance D3 is greater than the distance D1, which is greater than the distance D2 (i.e., D3>D1>D2). Increasing distance D3 further prevents any adhesive from flowing into the cavity 216. In other examples, D3 is greater than D2, which is equal to D1 (i.e., D3>D2=D1). In yet other examples, distance D1, distance D2, and distance D3 are equal (i.e., D1=D2=D3). In still other examples, distance D1 is equal to distance D3, which is greater than distance D2 (i.e., D1=D3>D2).

The ledge 218 has a width ($W_L$) that is wide enough to fit both of the channels 222, 224. In some examples, the ledge width ($W_L$) may be between 5-10 mm, and in a particular example the ledge width may be about 8 mm. The ledge width ($W_L$) may also be variable as it extends around the golf club 200 and the perimeter of the opening. For example, near the front of the golf club head (near the striking face 208), the ledge width ($W_L$) may be the greatest as the largest amount of stress occurs near the striking face 208. As such, it may be more desirable to have the bonding surface of the ledge 218 be the largest near the striking face 208. The stresses occurring near the rear of the golf club head 200, however, are less than those near the striking face 208. Accordingly, the maximum ledge width is where the ledge 218 is disposed proximate the striking face 208 of the golf club head 200 and the minimum ledge width is where the ledge is disposed proximate a rear of the golf club head 200. A section view of the golf club 200 near the rear of the golf club head 200 is shown in FIG. 2C. The width ($W_L$) of the ledge 218 may be smaller near the rear the golf club head 200 because the bonding surface does not need to be as large. By having a variable width ($W_L$) of the ledge 218, the overall mass of the golf club head 200 can be reduced without sacrificing any substantial performance or durability. In some examples, the ratio between the maximum ledge width and the minimum ledge width may be about 2:1.

The volume of the channels 222, 224 may also vary with the size of the ledge 218. For example, the channels 222, 224 may have a maximum volume near the front of the golf club head 200 and the channels 222, 224 may have a minimum volume near the rear of the golf club head 200. By varying the volume of the channels 222, 224, the amount of adhesive added to the channels may also vary based on the varied volume of the channels 222, 224 such that the adhesive does not overflow into the cavity 216.

In other examples, the channels 222, 224 may be located on the inner portion 206 rather than the ledge 218. In such examples, the adhesive may be applied directly to the inner portion 206 rather than the ledge 218. In other examples, both the inner portion 206 and the ledge 218 may include channels similar to channels 222, 224.

Figure 3:
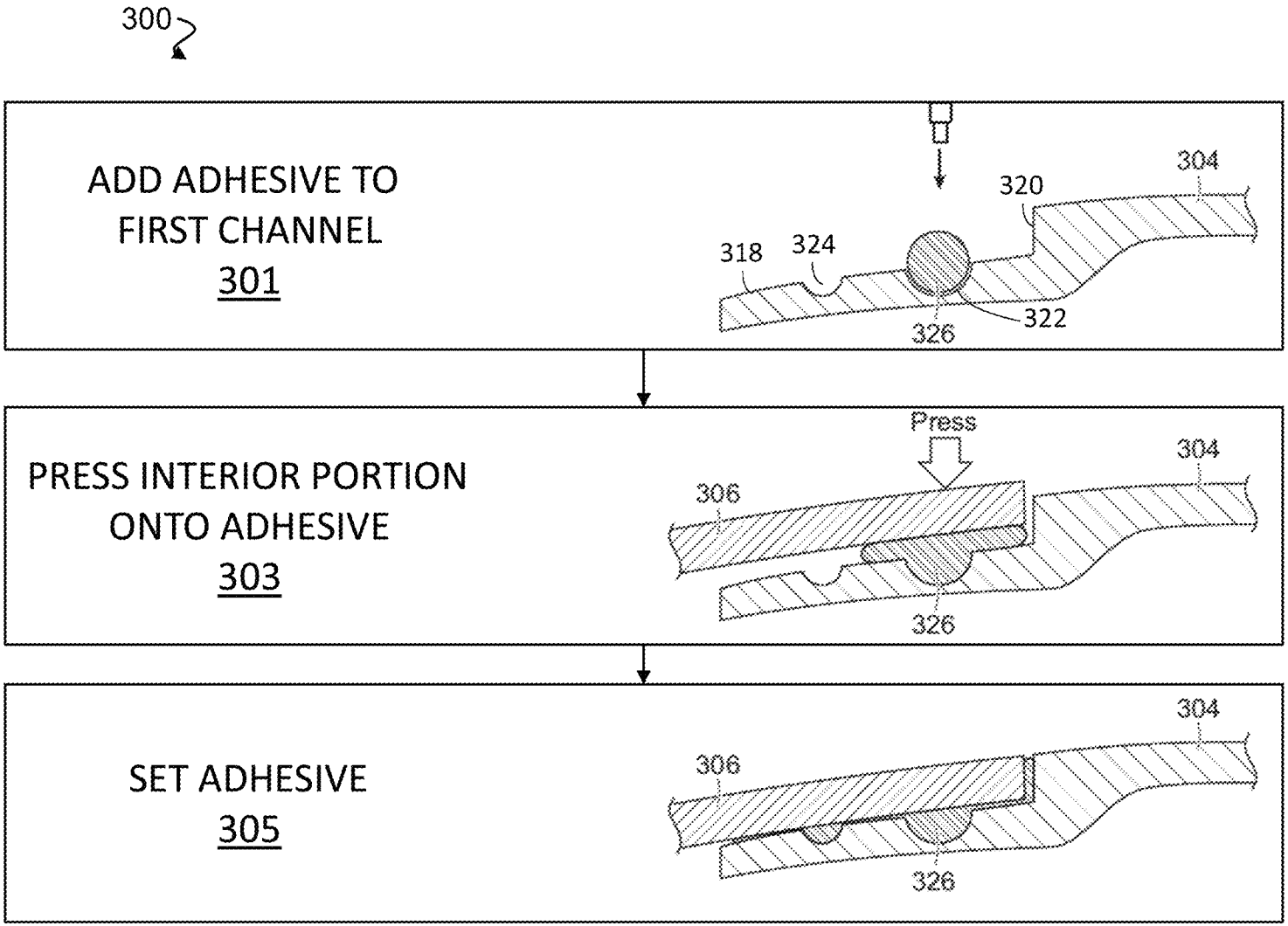
FIG. 3 depicts a process for attaching an inner portion of the crown of the example golf club head depicted in FIGS. 2A-2D.

FIG. 3 depicts an example method 300 for securing an inner portion 306 of a crown to a ledge 318 having a first channel 322 and a second channel 324. At operation 301, adhesive 326 is added to the first channel 322. The amount of the adhesive is based on the volume of the first channel 322 and/or the volume of the second channel 324. In some examples, the volume of adhesive 326 that is added into the first channel 322 is equal to about 150-200% of the volume of the first channel 322.

At operation 303, the interior portion 306 is pressed onto the adhesive 326 to secure the interior portion 306 to the ledge 318 and the remainder of the outer portion 304 of the crown. At operation 305, the adhesive 326 is allowed to spread and set, dry, or cure to establish the bond between the interior portion 306 and the ledge 318. As the adhesive 326 spreads from the first channel 322, some of the adhesive 326 is captured by the second channel 324, which serves as an overflow channel. The adhesive 326 also spreads towards the riser 320. As such, the primary bonding surface is between the riser 320 and the inner edge of the second channel 324. In some examples, the adhesive may also spread between the inner portion 306 and the riser 320, which causes the inner portion 306 to be bonded directly to the riser 320. In other examples, the adhesive 326 may not flow in between the riser 320 and the inner portion 306. Once the adhesive 326 has set, dried, or cured, the crown can be polished to remove any excess adhesive 326 that may have flowed to the surface of the crown.

Figure 4A:
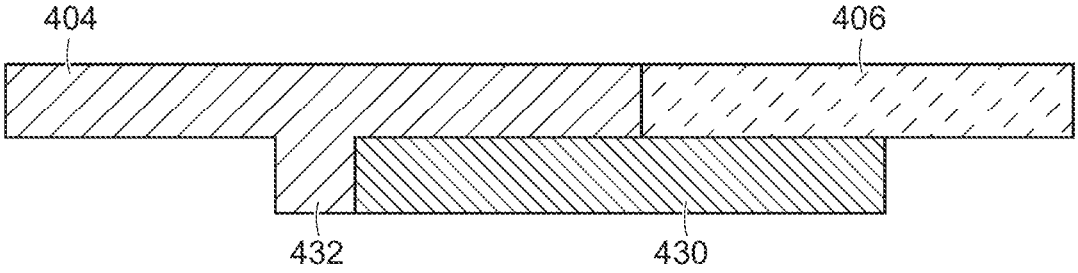
FIGS. 4A-4G depict example attachment configurations for attaching an inner portion of a crown to a golf club head.
Figure 4B:
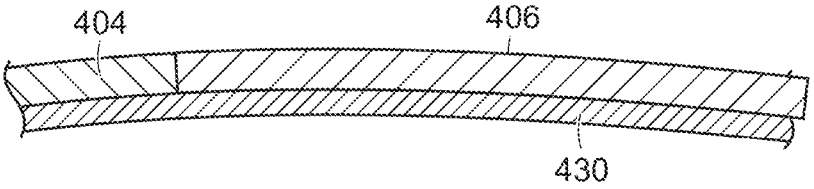

FIGS. 4A-4G depict multiple configurations for attaching an inner portion 406 of a crown to an outer portion 404 of the crown. FIG. 4A depicts an example configuration that utilizes a shelf 430 rather than a ledge as discussed in the examples above. The shelf 430 is attached to the internal surface, or underside, of the outer portion 404 of the crown. The inner portion 406 is then attached directly to shelf 430. The various components may be attached to one another by adhesive or other bonding techniques. The shelf 430 may be made of a composite material or other suitable materials. The outer portion 404 of the crown may also define a locating rib 432 on the underside of the outer portion 404. The locating rib 432 assists in the placement of the shelf 430. For instance, the shelf 430 can be inserted into the opening and placed against the locating rib 432 to help ensure proper placement of the shelf 430. FIG. 4B depicts another example configuration that utilizes a shelf 430 that is substantially similar to the example configuration depicted in FIG. 4A. In the configuration depicted in FIG. 4B, however, no locating rib is utilized.

Figure 4C:
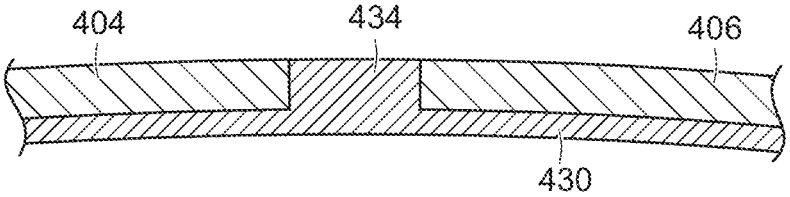

FIG. 4C depicts another example configuration that utilizes a shelf 430. In the configuration depicted in FIG. 4C, the shelf 430 defines a locating rib 434. The locating rib 434 defined by the shelf 430 is placed between the outer portion 404 and the inner portion 406. The locating rib 434 may have a width of about 5-10 mm. The locating rib 434 allows for easier placement of the shelf 430 during assembly or manufacturing of the golf club head. In addition, the locating rib 434 provides strength to the crown by protecting and separating the relatively weaker inner crown portion 406 from the outer crown portion 404.

Figure 4D:
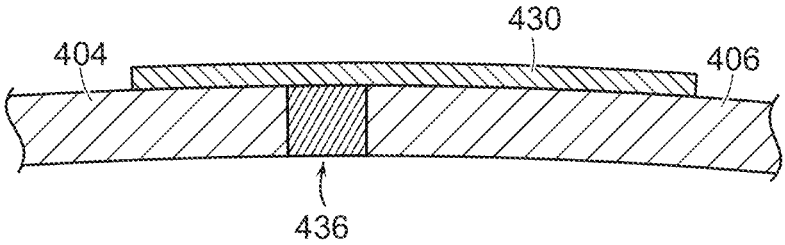

FIG. 4D depicts another example configuration that utilizes a shelf 430. In the configuration depicted in FIG. 4D, the shelf 430 is attached to the top side of the outer portion 404 and the inner portion 406. In such an example, the shelf 430 can be made of a material that is visually appealing to add additional effect to the top surface of the crown. In addition, the shelf 430 protects the joint between the inner portion 406 and the outer portion 404 from exterior debris or other interference. A spacer 436 may also be incorporated between the inner portion 406 and the outer portion 404. The spacer 436 may be made from a polymer material or other material that is less rigid than the outer portion 404 and the inner portion 406. The spacer 436 provides an additional buffer between the more rigid materials of the outer portion 404 and the inner portion 406, which increases the durability of the joint and the golf club head. As such, a wider variety of materials may be selected for the inner portion 406. In some examples, the spacer 436 may be omitted.

Figure 4E:
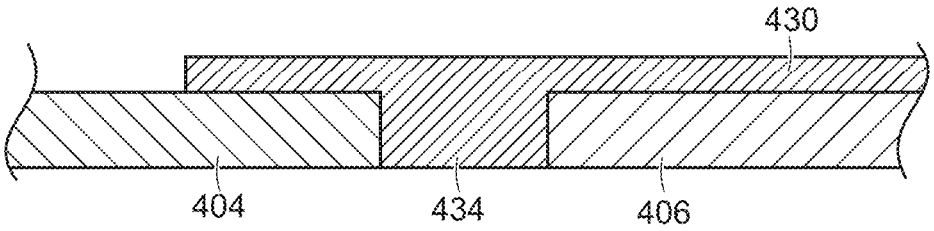

FIG. 4E depicts another example configuration that utilizes a shelf 430. In the configuration depicted in FIG. 4E, the shelf 430 is also on the top side of the crown and the shelf 430 also defines a locating rib 434. The shelf 430 and the locating rib 434 are substantially the same as the shelf 430 and the locating rib 434 depicted in FIG. 4C. However, the shelf 430 is attached to the top side of the inner portion 406 and the top side of the outer portion 404 such that the locating rib 434 protrudes downward towards the cavity.

Figure 4F:
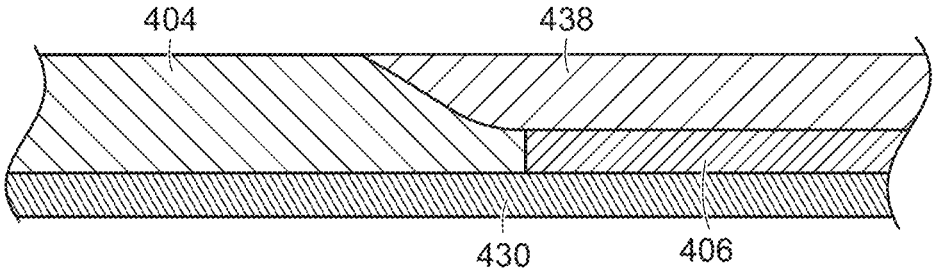

FIG. 4F depicts another example configuration for attaching an inner portion 406 of a crown to an outer portion 404 of the crown. In the configuration depicted in FIG. 4F, the outer portion defines a ledge 418 and also utilizes a shelf 430 underneath the outer portion 404 and the ledge 418. In the configuration depicted in FIG. 4F, however, the inner portion 406 is attached to the shelf 430 and abuts the edge of the ledge 418. A cover 438 is attached to the top side of the inner portion 406 and the ledge 418. The cover 438 may be made of the same type of materials as the shelf 430. The shape of the cover 438 may also be manufactured to fit with the shape of the ledge 418 defined by the outer portion 404. The configuration depicted in FIG. 4F allows for further protection of the inner portion 406.

Figure 4G:
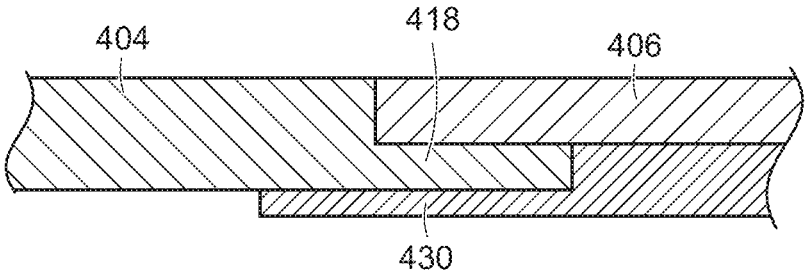

FIG. 4G depicts another example configuration for attaching an inner portion 406 of a crown to an outer portion 404 of the crown. In the configuration depicted in FIG. 4G, the outer portion 404 defines a ledge 418 and the inner portion 406 is attached to the ledge 418, similar to the configurations discussed above with reference to FIGS. 1A-1C, 2A-2C, and 3. A shelf 430 is also added to the configuration. The shelf 430 is attached on the underside of the outer portion 404 and, at least in part, underneath the ledge 418. The shelf 430 extends from underneath the ledge 418 towards the center of the opening to provide further support for the inner portion 406, which is attached to the shelf 430 with an adhesive or other bonding material. The shelf 430 is also shaped in manner such that the portion of the shelf 430 extending beyond the ledge 418 is flush with the ledge 418. Thus, the ledge is sandwiched between the shelf 430 and the inner portion 406. Any of the configurations depicted in FIGS.

4A-4G may also include channels in the shelf 430 similar to the channels 222, 224 described above with reference to FIGS. 2A-2C.

Figure 5A:
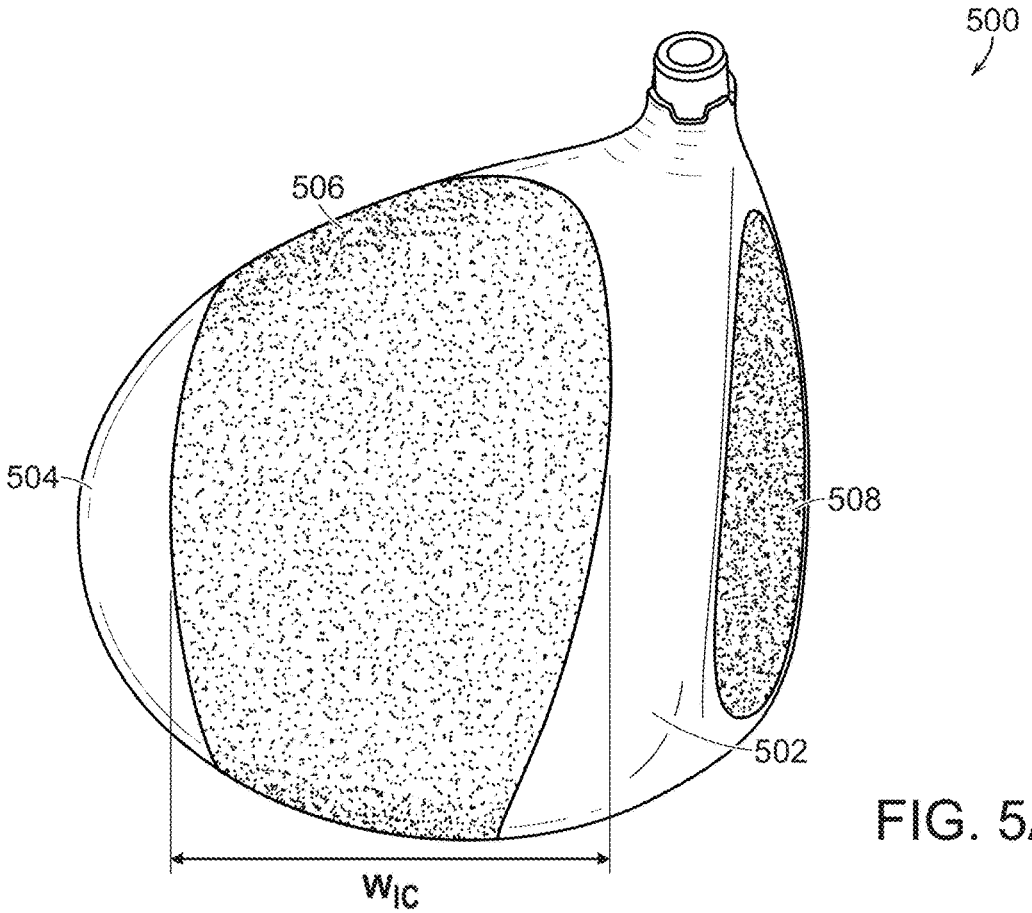
FIG. 5A depicts a top view of an example golf club with a low modulus inner crown portion and a low modulus inner sole portion.
Figure 5B:
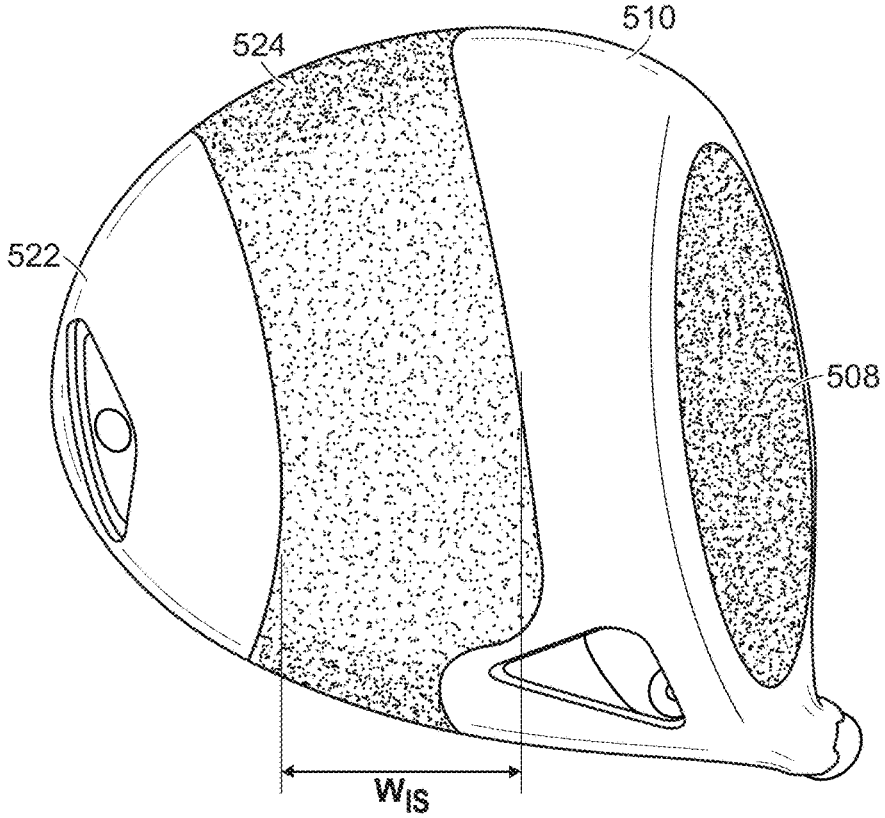
FIG. 5B depicts a bottom view of the example golf club of FIG. 5A.
Figure 5C:
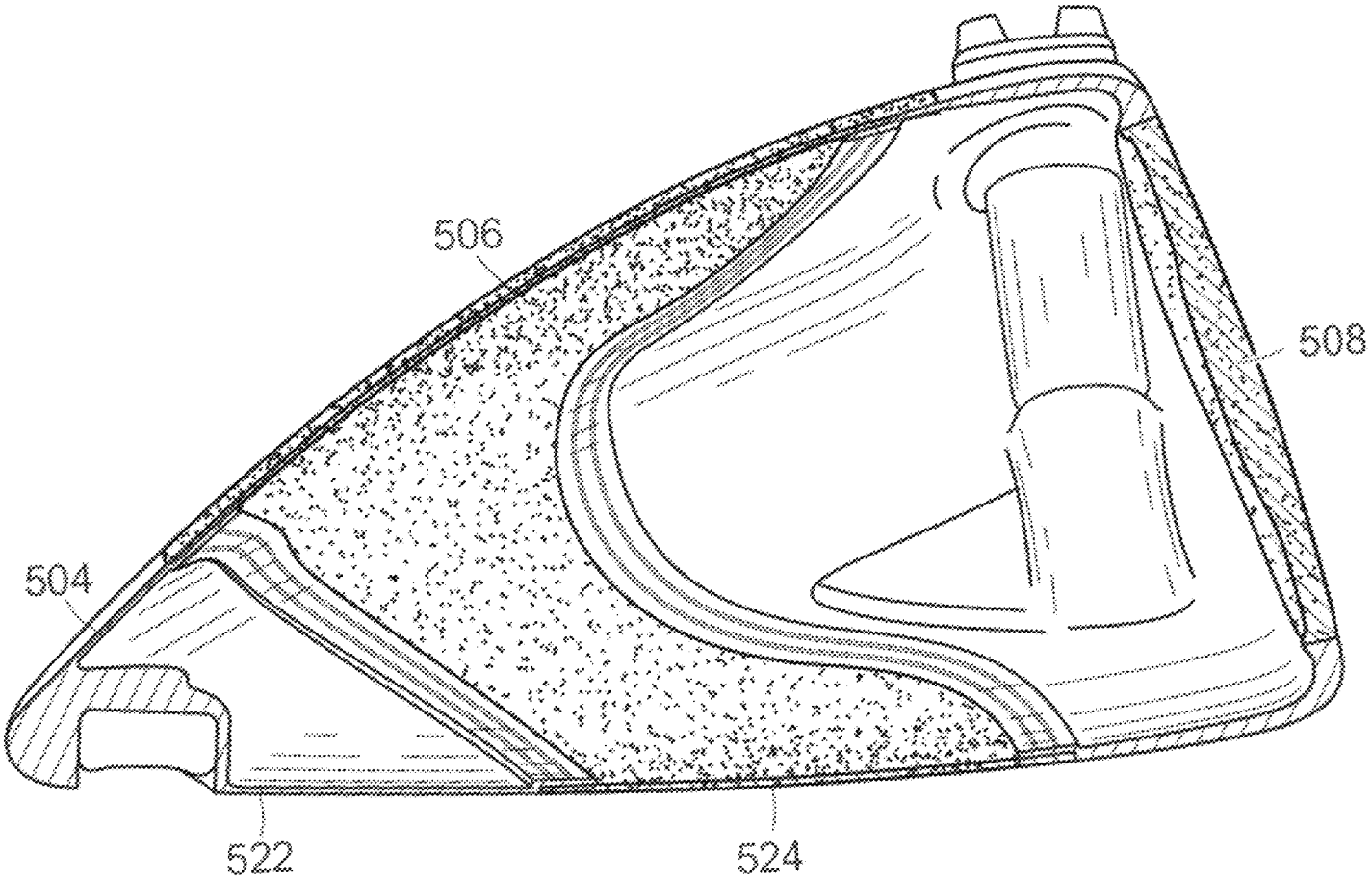
FIG. 5C depicts a section view of the example golf club of FIGS. 5A-5B.

FIGS. 5A-5C depict different views of an example golf club head 500 with a low modulus inner crown portion 506 of a crown 502 and a low modulus inner sole portion 524 of a sole 510. In particular, FIG. 5A depicts a top view of the example golf club head 500, FIG. 5B depicts a bottom view of the example golf club head 500, and FIG. 5C depicts a section view of the example golf club head 500. FIGS. 5A-5C are discussed concurrently. The inner crown portion 506 of the golf club head 500 is similar to the inner portions of a crown discussed above. For instance, the inner crown 506 is attached to an outer crown portion 504. The outer crown portion 504 may define an opening into a cavity of the golf club head. The outer crown portion 504 may similarly define a crown riser extending into the cavity and a crown ledge extending towards the center of the opening. The inner crown portion 506 is then attached to the crown ledge. The inner crown portion 506 may also be attached to the outer crown portion 504 by any of the configurations discussed above (e.g., those attachment configurations that utilize a discrete shelf).

The golf club head 500 also includes an inner sole portion 524 that is connected to an outer sole portion 522 of the sole 510. The inner sole portion 524 is similar to the inner crown portion 506, and can be attached to the outer sole portion 522 by substantially similar configurations as discussed above with reference to configurations for attaching the inner crown portion 506 to the outer crown portion 504. For instance, the outer sole portion 522 may define an opening to the cavity. The outer sole portion 522 may also define a sole riser extending into the cavity and a ledge extending from the top edge of the sole riser towards the center of the opening in the sole 510. The inner sole portion 524 may be attached to the sole ledge. In addition, the sole ledge and the crown ledge may also include channels for adhesive, such as the channels discussed above in FIGS. 2A-C and 3.

The inner sole portion 524 and the inner crown portion 506 may form a single continuous piece that is attached to the outer crown portion 504 and the outer sole portion 522. For instance, the inner crown portion 506 wraps around the heel and toe of the golf club head 500 and connects with the inner sole portion 524. In such an example, the opening defined by the outer crown portion 504 and the opening defined by the outer sole portion 522 may form a single continuous opening. The size and shape of the combined inner crown portion 506 and the inner sole portion 524 may vary in different examples. In some examples, the inner crown portion 506 may be about 50-100% of the exterior surface area of the crown 502. In some examples, the size of the inner crown portion 506 is at least 85% of the exterior surface area of the crown 502. The inner sole portion 524 may make up similar proportions of the sole 510. In other examples, the inner sole portion 524 may make up less of the total exterior surface area of sole 510 due to other components located on the sole 510. For instance, in some examples, the inner sole portion 524 is shaped so as to avoid sole components such as active recoil channels, weights or weight ports, and openings for adjusting a hosel, among other components (as can be seen in the example depicted in FIGS. 6A-6B). The inner crown portion 506 also has a variable width ($W_{IC}$) and the inner sole portion 524 has a variable width ($W_{IS}$) as well. The widths $W_{IC}$ and $W_{IS}$ may be measured on an arc following the shape of the crown or the sole, respectively, and running orthogonal to the striking face 508. The ratio of the maximum width $W_{IC}$ to the maximum width $W_{IS}$ may be about 2:1, 3:2, 1:1, 1:2 or within the range of about 1:1 to 2:1. The particular ratio between the maximum width $W_{IC}$ to the maximum width $W_{IS}$ may depend on other elements incorporated into the sole 510 or crown 502 of the golf club head 500. For instance, in examples where the sole 510 includes other elements for improved flexibility, such as an active recoil channel, the width $W_{IS}$ may be substantially less than that of the width $W_{IC}$.

Figure 5D:
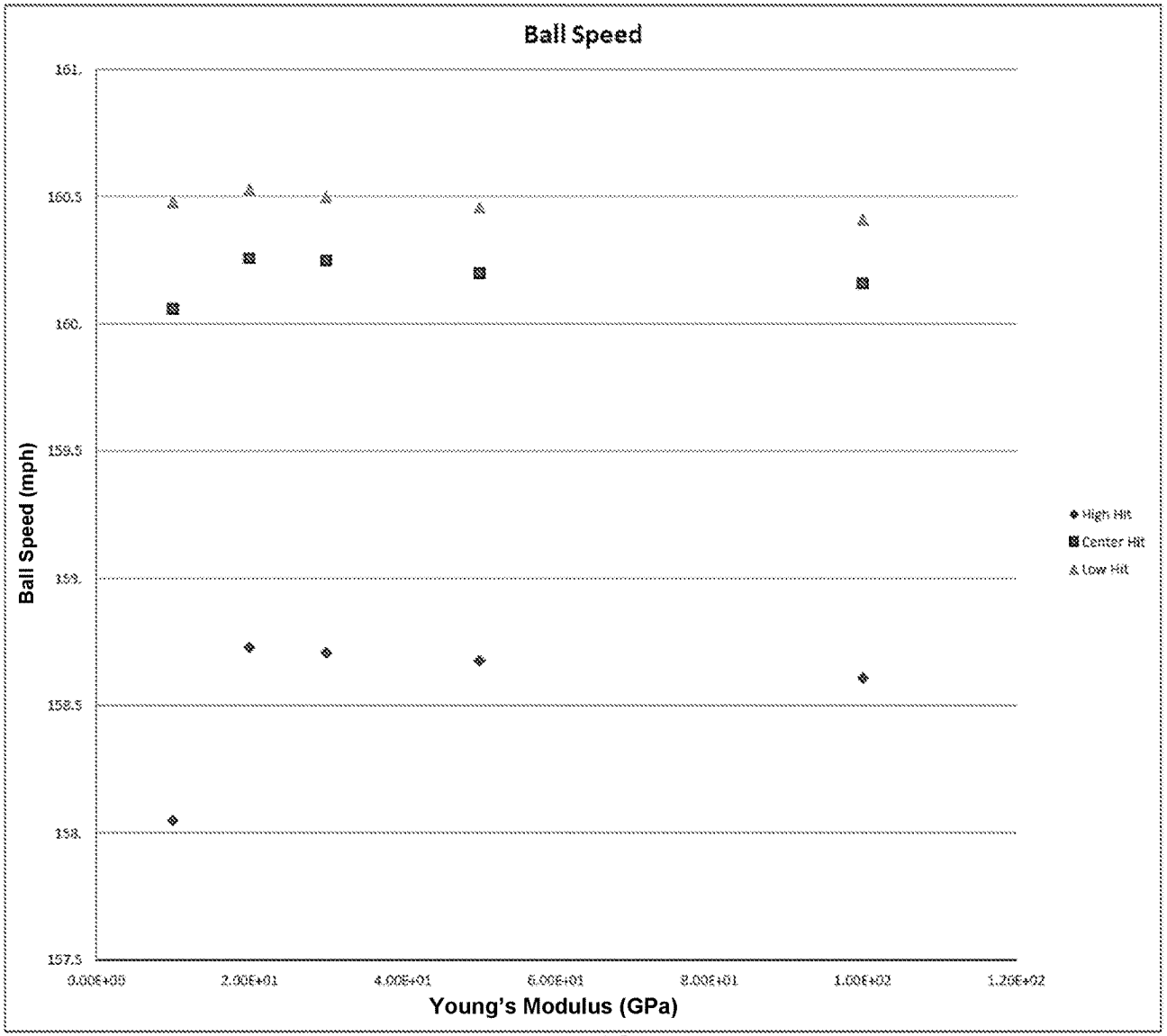
FIG. 5D is a plot showing the effect of elastic modulus on ball speed for the example golf club of FIGS. 5A-5C.

FIG. 5D is a plot showing the effect of elastic modulus of an inner crown portion and an inner sole portion on ball speed for the example golf club of FIGS. 5A-5C. Multiple data points are shown for high ball strikes, center ball strikes, and low ball strikes. A high ball strike is a strike of a golf ball at about a half inch above face center, a center ball strike is a ball strike occurring at about face center, and a low ball strike is a ball strike occurring at about a half inch below face center. From the plot, the unexpected result is seen that ball speed is increased for all types of ball strikes for elastic modulus values between about 20-40 GPa. Accordingly, by incorporating both an inner crown portion and an inner sole portion having a particular elastic modulus value, ball speed performance can be improved for all ball strikes, whether the ball strikes are high, center, or low on the face.

Figure 5E:
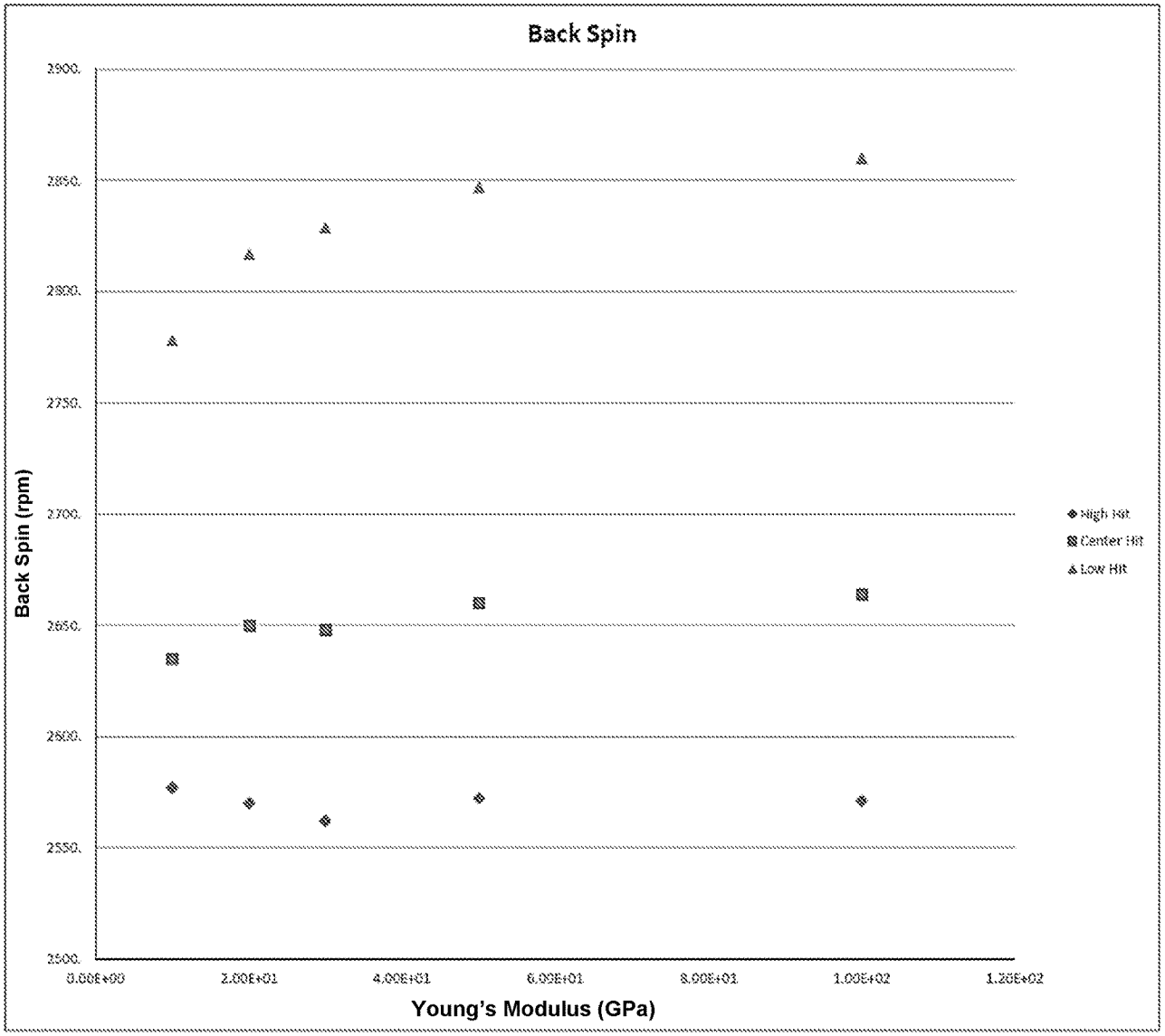
FIG. 5E is a plot showing the effect of elastic modulus on backspin for the example golf club of FIGS. 5A-5C.

FIG. 5E is a plot showing the effect of elastic modulus of an inner crown portion and an inner sole portion on backspin for the example golf club of FIGS. 5A-5C. Multiple data points are shown for high ball strikes, center ball strikes, and low ball strikes. Each respective ball strike type has a range of elastic modulus values that provide lower backspin values, which results in further carry distance. For example, at an elastic modulus value of about 20-40 GPa, the backspin characteristics are relatively low for all ball strike types compared to other elastic modulus values. Accordingly, utilization of a material having an elastic modulus between about 20 GPa to 40 GPa results in both lower backspin and increased ball speed.

Figure 6A:
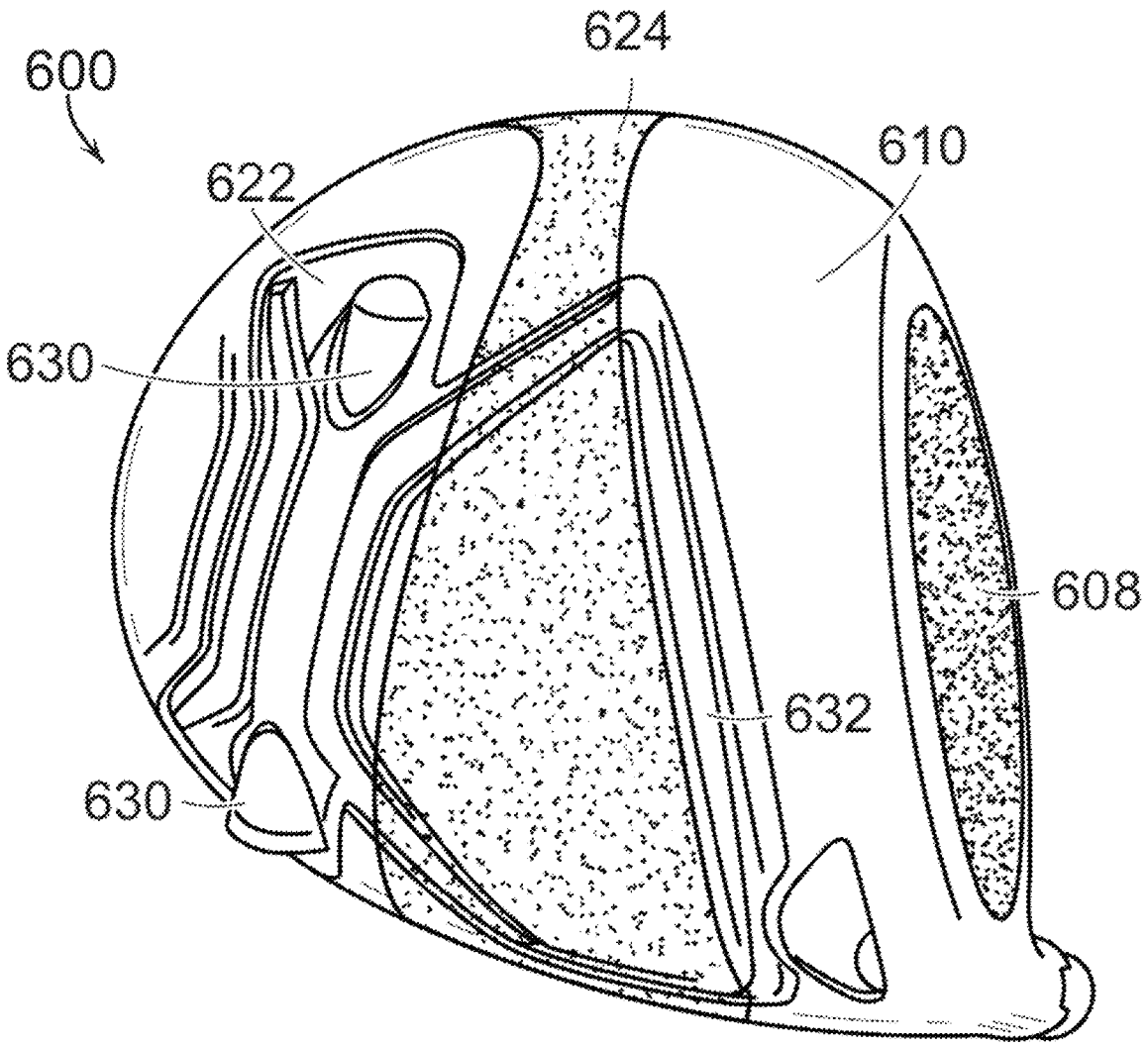
FIG. 6A depicts a bottom view of another example golf club with a low modulus inner crown portion and a low modulus inner sole portion.
Figure 6B:
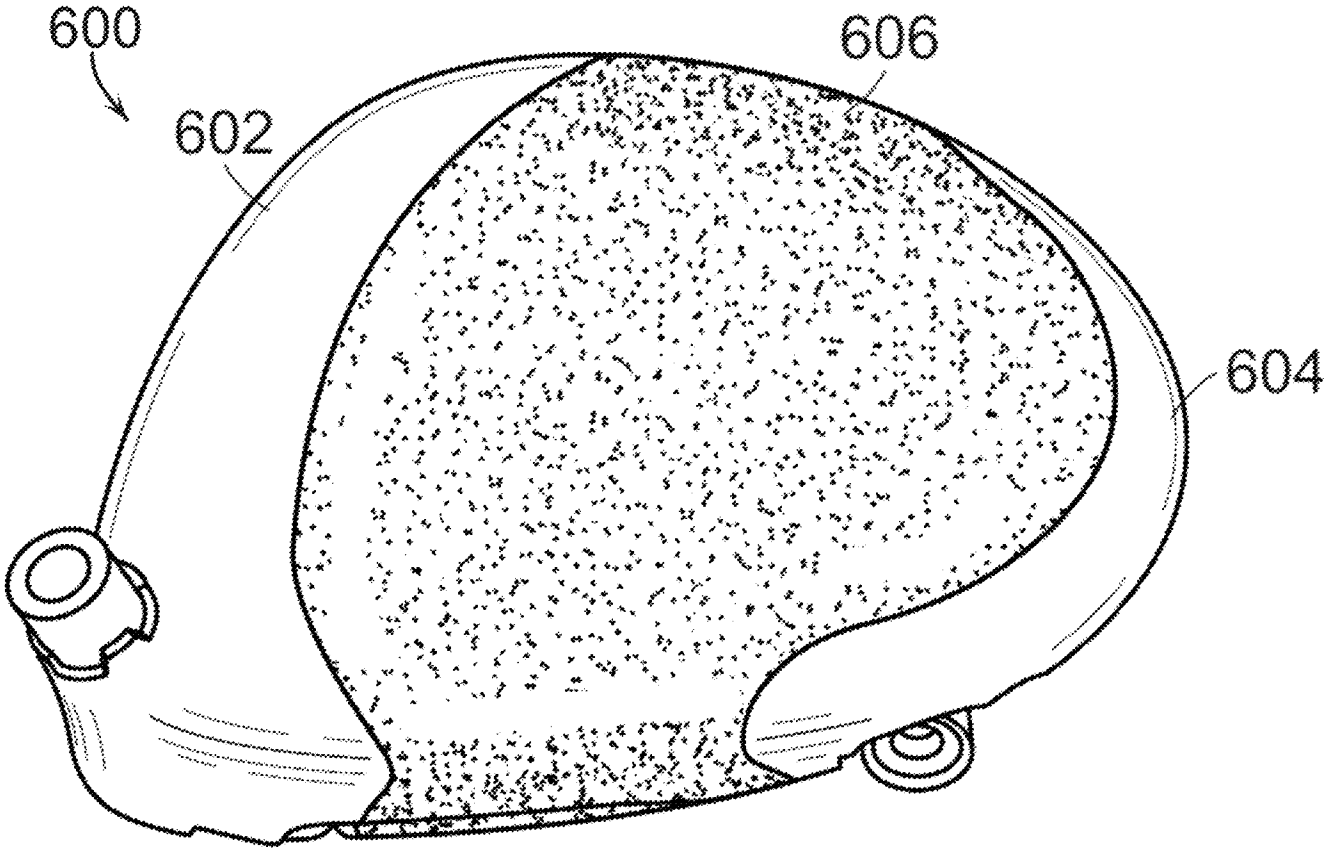
FIG. 6B depicts a top view of the example golf club of FIG. 6A.

FIGS. 6A-6B depict different views of another example golf club head 600 with a low modulus inner crown portion 606 of a crown 602 and a low modulus inner sole portion 624 of a sole 610. In particular, FIG. 6A depicts a bottom view of the example golf club head 600 and FIG. 6B depicts a top view of the example golf club head 600. FIGS. 6A-6B are discussed concurrently. The golf club head 600 is substantially the same as the golf club head 500 depicted in FIGS. 5A-5C and discussed above, except for the shape of the inner crown portion 606 and the inner sole portion 624. The inner sole portion 624 is narrower than that of the inner sole portion 524 depicted in FIGS. 5A-5C to avoid interference with the adjustable weight 630 and the active recoil channel 632. As such, the outer sole portion 622 comprises more of the sole 610 than the inner sole portion 624.

Figure 6C:
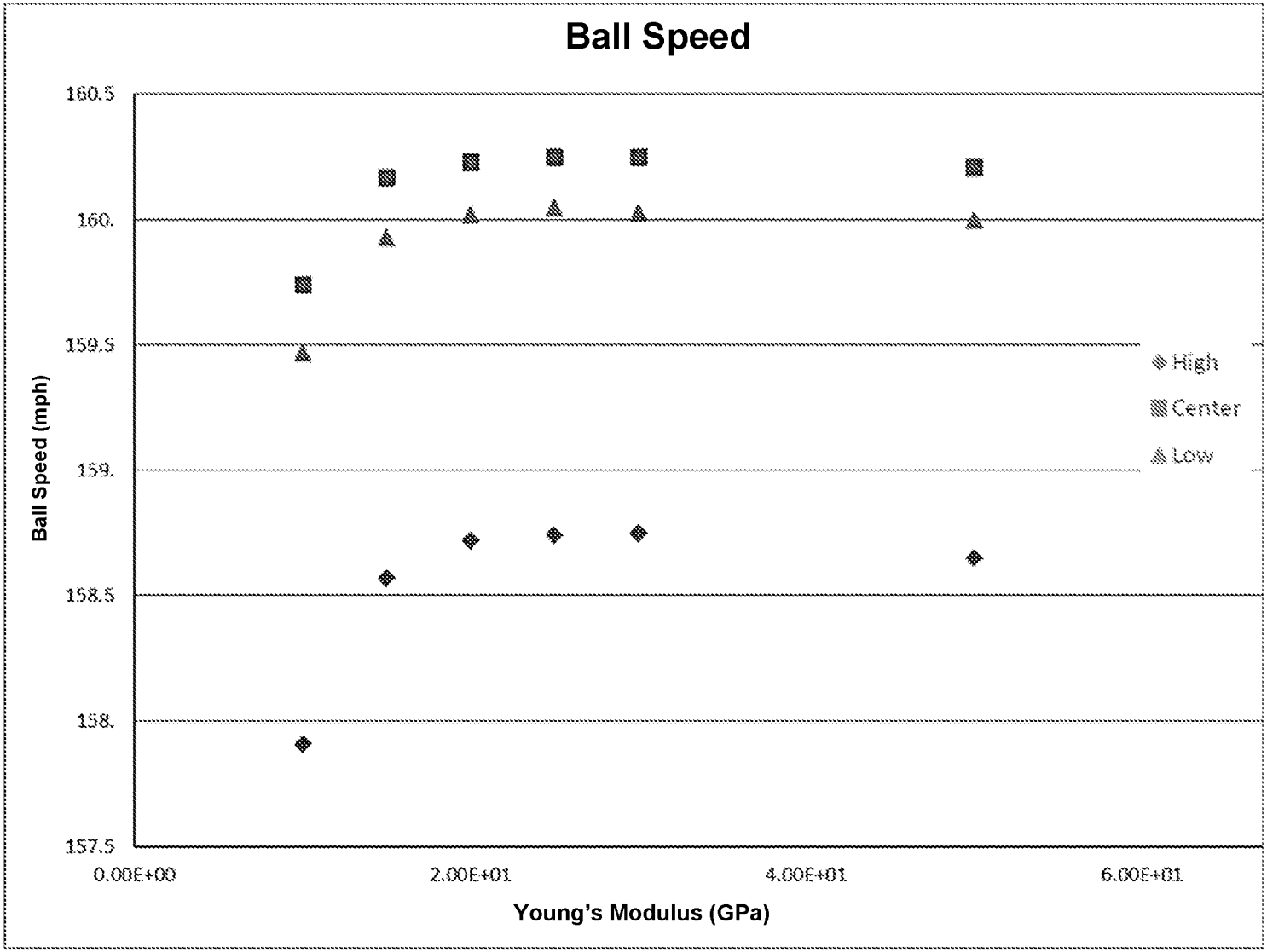
FIG. 6C is a plot showing the effect of elastic modulus on ball speed for the example golf club of FIGS. 6A-6B.

FIG. 6C is a plot showing the effect of elastic modulus of an inner crown portion and an inner sole portion on ball speed for the example golf club of FIGS. 6A-6B. Multiple data points are shown for high ball strikes, center ball strikes, and low ball strikes. From the plot, the unexpected result is seen that ball speed is increased for all types of ball strikes for elastic modulus values between about 15-40 GPa. Accordingly, by incorporating both an inner crown portion and an inner sole portion having a particular elastic modulus value, ball speed performance can be improved for all ball strikes, whether the ball strikes are high, center, or low on the face.

Figure 6D:
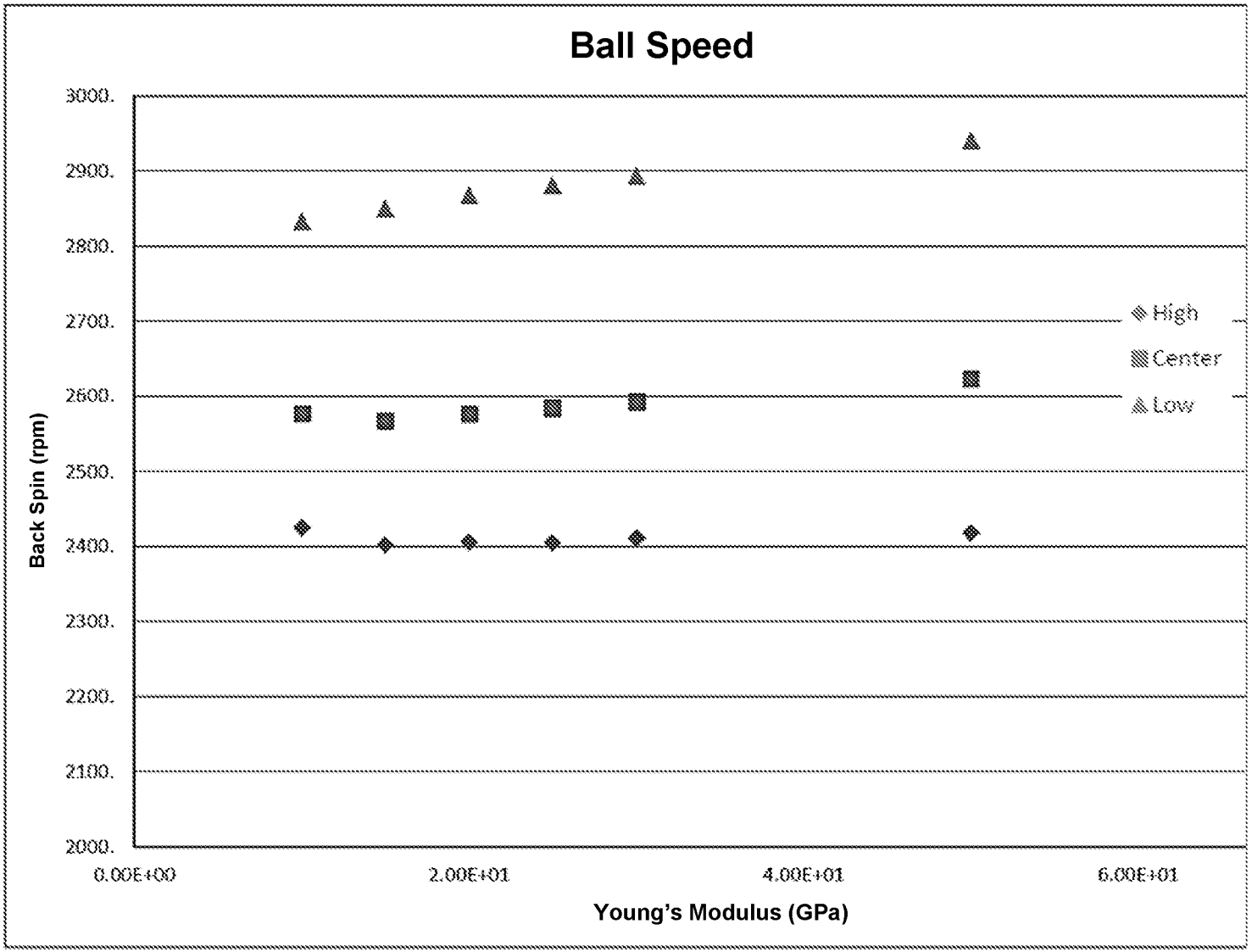
FIG. 6D is a plot showing the effect of elastic modulus on backspin for the example golf club of FIGS. 6A-6B.

FIG. 6D is a plot showing the effect of elastic modulus of an inner crown portion and an inner sole portion on backspin for the example golf club of FIGS. 6A-6B. Multiple data points are shown for high ball strikes, center ball strikes, and low ball strikes. Each respective ball strike type has range of elastic modulus values that provides lower backspin values, which results in further carry distance. For example, at an elastic modulus value of about 15-40 GPa, the backspin characteristics are relatively low for all ball strike types compared to other elastic modulus values. Accordingly, utilization of a material having an elastic modulus between about 15-40 GPa results in both lower backspin and increased ball speed.

Figure 7:
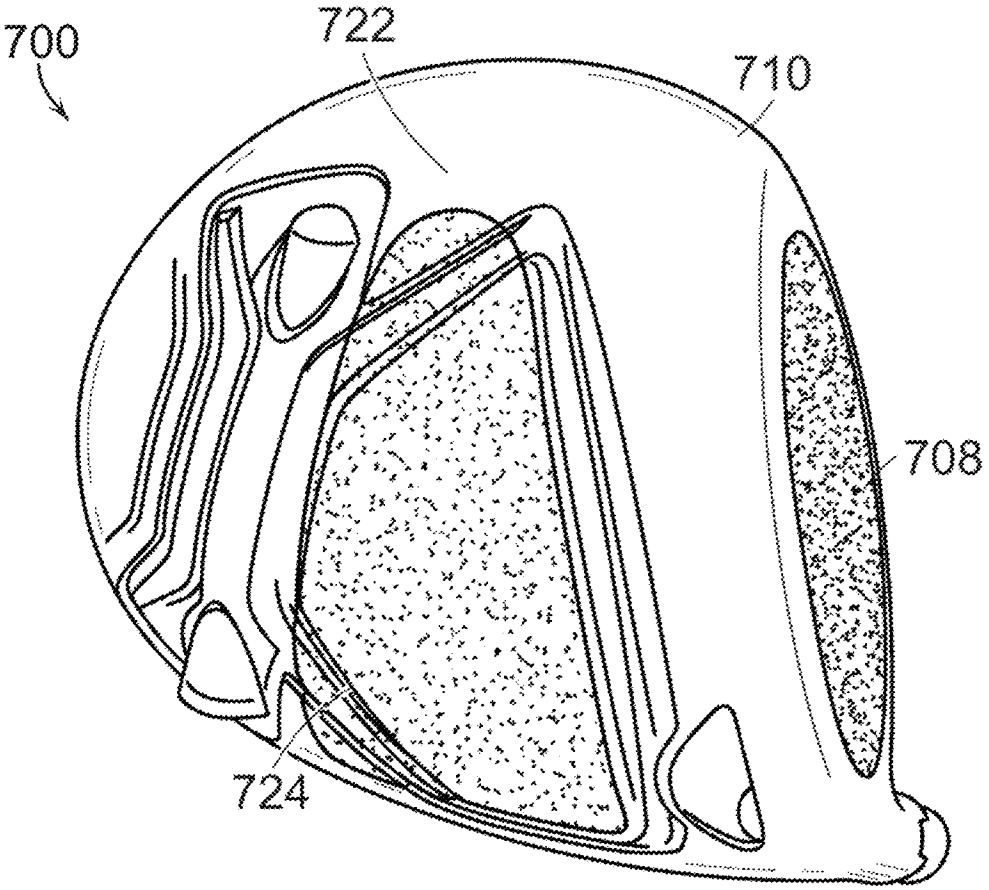
FIG. 7 depicts a bottom view of an example golf club with a low modulus inner sole portion.

FIG. 7 depicts an example of a golf club head 700 having a low modulus inner sole portion 724 in the sole 710. The inner sole portion 724 may be substantially similar to the inner sole portion 524 depicted in FIGS. 5A-5C and the inner sole portion 624 depicted in FIGS. 6A-6B, with the exception that the inner sole portion 724 may be discrete from any inner crown portion. In some examples, the golf club head 700 may not incorporate an inner crown portion. The inner sole portion 724 may be about 30-90% of the exterior surface area of the sole 702. In some examples, the size of the inner sole portion 724 is at least 65% of the exterior surface area of the crown. The inner sole portion 724 may be attached to the outer sole portion 722 through any of the means or configurations discussed above. As the inner sole portion 724 is located closer to the striking face 708, backspin of a golf ball from resulting strikes at or below face center is further reduced.

Although specific embodiments and aspects were described herein and specific examples were provided, the scope of the technology is not limited to those specific embodiments and examples. For instance, while many of the present examples have been depicted for use with a driver, the present technology may be applied to any metal wood, fairway metal or wood, or hybrid golf club. Further, each of the above examples may be combined with another. One skilled in the art will recognize other embodiments or improvements that are within the scope and spirit of the present technology. Therefore, the specific structure, acts, or media are disclosed only as illustrative embodiments. In addition, if the limits of the terms "about," "substantially," or "approximately" as used in the following claims are unclear from the foregoing specification to one having skill in the art, those terms shall mean within ten percent of the value described. The scope of the technology is defined by the following claims and any equivalents therein.

The invention claimed is:

1. A golf club head comprising:
- a sole positioned on a bottom side of the golf club head;
- a striking face positioned toward a front of the golf club head and attached to at least a portion of the sole; and
- a crown positioned on a top side of the golf club head such that a cavity is formed between the sole, the striking face, and the crown, wherein the crown includes:
  - an outer portion made of a first material, wherein the outer portion defines:
    - an opening to the cavity;
    - a riser extending into the cavity, the riser having a bottom edge; and
    - a ledge extending from the bottom edge of the riser;
  - a shelf attached to an underside of the outer portion;
  - an inner portion abutting the ledge and attached to the shelf, the inner portion made of a second material displaying an elastic modulus of about 10 GPa to about 50 GPa, wherein the inner portion of the crown covers the opening to the cavity; and
  - a cover attached to a top side of the inner portion and the ledge.

2. The golf club head of claim 1, wherein the first material is titanium and the second material is a magnesium-based material.

3. The golf club head of claim 1, wherein the second material displays an elastic modulus of between about 5 GPa to about 20 GPa.

4. The golf club head of claim 1, wherein the ledge has a width between 5-10 millimeters.

5. The golf club head of claim 1, wherein the cover and the shelf are made of a third material.

6. The golf club head of claim 1, wherein:
- the outer portion has a first thickness;
- the inner portion has a second thickness; and
- the cover has a third thickness, wherein a sum of the third thickness and the second thickness is equal to about the first thickness.

7. The golf club head of claim 6, wherein the third thickness is greater than the second thickness.

8. A golf club head comprising:
- a sole positioned on a bottom side of the golf club head;
- a striking face positioned toward a front of the golf club head and attached to at least a portion of the sole; and
- a crown positioned on a top side of the golf club head such that a cavity is formed between the sole, the striking face, and the crown, wherein the crown includes:
  - an outer portion made of a first material, wherein the outer portion defines:
    - an opening to the cavity;
    - a riser extending into the cavity, the riser having a bottom edge; and
    - a ledge extending from the bottom edge of the riser;
  - a shelf attached to an underside of the outer portion;
  - an inner portion attached to the shelf and the ledge, the inner portion made of a second material displaying an elastic modulus less than an elastic modulus of the first material, wherein the inner portion of the crown covers the opening to the cavity; and
  - a cover attached to a top side of the inner portion and the ledge.

9. The golf club head of claim 8, wherein the first material is titanium and the second material is a magnesium-based material.

10. The golf club head of claim 8, wherein the second material displays an elastic modulus of between about 5 GPa to about 20 GPa.

11. The golf club head of claim 8, wherein the cover and the shelf are made of a third material.

12. The golf club head of claim 8, wherein:
- the outer portion has a first thickness;
- the inner portion has a second thickness; and
- the cover has a third thickness, wherein a sum of the third thickness and the second thickness is equal to about the first thickness.

13. The golf club head of claim 12, wherein the third thickness is greater than the second thickness.

14. A golf club head comprising:
- a sole positioned on a bottom side of the golf club head;
- a striking face positioned toward a front of the golf club head and attached to at least a portion of the sole; and
- a crown positioned on a top side of the golf club head such that a cavity is formed between the sole, the striking face, and the crown, wherein the crown includes:
  - an outer portion made of a first material, wherein the outer portion defines:
    - an opening to the cavity;
    - a riser extending into the cavity, the riser having a bottom edge; and a ledge extending from the bottom edge of the riser;

a shelf attached to an underside of the outer portion; and an inner portion in contact with the ledge and the shelf, the inner portion made of a second material displaying an elastic modulus less than an elastic modulus of the first material, wherein the inner portion of the crown covers the opening to the cavity.

15. The golf club head of claim 14, wherein the first material is titanium and the second material is a magnesium-based material.

16. The golf club head of claim 14, wherein the second material displays an elastic modulus of between about 5 GPa to about 20 GPa.

17. The golf club head of claim 14, further comprising a cover attached to a top side of the inner portion and the ledge.

18. The golf club head of claim 17, wherein the cover and the shelf are made of a third material.

19. The golf club head of claim 17, wherein:

the outer portion has a first thickness;

the inner portion has a second thickness; and the cover has a third thickness, wherein a sum of the third thickness and the second thickness is equal to about the first thickness.

20. The golf club head of claim 19, wherein the third thickness is greater than the second thickness.

* * * * *